US010668501B2

(12) United States Patent
Portet et al.

(10) Patent No.: US 10,668,501 B2
(45) Date of Patent: Jun. 2, 2020

(54) PROCESS FOR OBTAINING SUPERHYDROPHOBIC OR SUPERHYDROPHILIC SURFACES

(71) Applicants: Centre National de la Recherche Scientifique (CNRS), Paris (FR); Surfactis Technologies, Angers (FR)

(72) Inventors: David Portet, Briollay (FR); Nicolas Lefevre, Angers (FR); Stéphane Bejanin, Paris (FR); Abdelhafed Taleb, Ivry sur Seine (FR); Dorra Ben Jazia Dallel, Orsay (FR); Olivier Favrat, Angers (FR)

(73) Assignees: Centre National de la Recherche Scientifique (CNRS) (FR); Surfactis Technologies (FR)

( * ) Notice: Subject to any disclaimer, the term of this patent is extended or adjusted under 35 U.S.C. 154(b) by 7 days.

(21) Appl. No.: 15/311,938

(22) PCT Filed: May 20, 2015

(86) PCT No.: PCT/EP2015/061145
§ 371 (c)(1),
(2) Date: Nov. 17, 2016

(87) PCT Pub. No.: WO2015/177229
PCT Pub. Date: Nov. 26, 2015

(65) Prior Publication Data

US 2017/0120294 A1 May 4, 2017

(30) Foreign Application Priority Data

May 20, 2014 (FR) ..... 14 54496

(51) Int. Cl.
*B05D 5/00* (2006.01)
*B05D 5/08* (2006.01)
(Continued)

(52) U.S. Cl.
CPC ..... *B05D 5/083* (2013.01); *B05D 1/005* (2013.01); *B05D 1/12* (2013.01); *B05D 1/18* (2013.01);
(Continued)

(58) Field of Classification Search
CPC . B82Y 30/00; B05D 5/00; B05D 1/00; C08G 65/00; C08G 77/00; C09D 183/00;
(Continued)

(56) References Cited

U.S. PATENT DOCUMENTS 6,451,436 B1 * 9/2002 Komatsu ..... C09D 183/04 428/447
2003/0157344 A1 * 8/2003 Shoup ..... C08J 7/04 428/447
(Continued)

FOREIGN PATENT DOCUMENTS

WO WO 00/10934 * 3/2000
WO 2012138992 A2 10/2012

OTHER PUBLICATIONS

Meyerhofer D., "Characteristics of resist films produced by spinning," J. Appl. Phys., Jul. 1978, pp. 3993-3997, vol. 49, No. 7.
(Continued)

*Primary Examiner* — Gordon Baldwin
*Assistant Examiner* — Mohammad Mayy
(74) *Attorney, Agent, or Firm* — Lerner, David, Littenberg, Krumholz & Mentlik, LLP

(57) ABSTRACT

The present invention relates to a process for texturing surfaces providing the latter with superhydrophobic, superoleophobic, superhydrophilic or even superoleophilic properties. This process comprises i) a step of texturing the surface (via the deposition of nanoparticles of different sizes); ii) a step of curing the surface thus textured (with a curing agent); and, optionally, iii) a step of modifying the
(Continued)

100 nm: 0.5% by weight in ethanol, 0.25% by weight in ethanol properties of the surface with perfluorinated (and therefore hydrophobic) molecules. This process is suitable, inter alia, for treating transparent and/or heat-sensitive materials and surfaces. Specifically, none of the steps of the process use a temperature higher than 100° C. Thus, the process of the invention is particularly suitable for treating transparent surfaces composed of non-mineral materials, such as polycarbonate for example, as it will affect neither their transparency nor their optical properties.

17 Claims, 16 Drawing Sheets

(51) Int. Cl.

| | |
|---|---|
| ***B05D 1/18*** | (2006.01) |
| ***B05D 1/00*** | (2006.01) |
| ***B05D 1/12*** | (2006.01) |
| ***B05D 1/28*** | (2006.01) |
| ***B05D 1/30*** | (2006.01) |
| ***B05D 1/36*** | (2006.01) |
| ***B05D 3/04*** | (2006.01) |
| ***B05D 3/06*** | (2006.01) |
| ***B05D 3/10*** | (2006.01) |
| ***B05D 3/14*** | (2006.01) |

(52) U.S. Cl.
CPC ..... *B05D 1/28* (2013.01); *B05D 1/30* (2013.01); *B05D 1/36* (2013.01); *B05D 3/0446* (2013.01); *B05D 3/063* (2013.01); *B05D 3/108* (2013.01); *B05D 3/144* (2013.01); *B05D 5/08* (2013.01); *B05D 2201/00* (2013.01); *B05D 2203/35* (2013.01)

(58) Field of Classification Search
CPC .. G01N 33/00; G02B 1/00; Y10T 428/31612; Y10T 428/31663
See application file for complete search history.

(56) References Cited

U.S. PATENT DOCUMENTS

| | | | | |
|---|---|---|---|---|
| 2007/0244250 | A1* | 10/2007 | Yoshikawa | C08G 77/14 524/588 |
| 2009/0004462 | A1* | 1/2009 | Zhang | C08L 83/06 428/331 |
| 2013/0064990 | A1* | 3/2013 | Lu | B82Y 30/00 427/535 |
| 2013/0095290 | A1* | 4/2013 | Muisener | C09D 5/1693 428/141 |
| 2013/0115381 | A1 | 5/2013 | Schwartz et al. | |

OTHER PUBLICATIONS

Deng X. et al., "Transparent, Thermally Stable and Mechanically Robust Superhydrophobic Surfaces made from Porous Silica Capsules," Advanced Materials, May 3, 2011, p. 2962, vol. 23.
Karunakaran R. et al., "Highly Transparent Superhydrophobic Surfaces from the Coassembly of Nanoparticles (≤100 nm)," Langmuir, Feb. 28, 2011, pp. 4594-4602, vol. 27., American Chemical Society.
Landau L. et al., "Dragging of a Liquid by a Moving Plate, "Acta Physicochimica U.R.S.S., Jan. 1942, pp. 42-54, vol. 17, No. 1-2.
Ling X. Y. et al., "Stable and Transparent Superhydrophobic Nanoparticle Films," Langmuir, Feb. 3, 2009, pp. 3260-3263, vol. 25, No. 5.
Ming W. et al., "Superhydrophobic Films from Raspberry-like Particles," Nano Letters, Oct. 1, 2005, pp. 2298-2301, vol. 5, No. 11., American Chemical Society.
Stober W. et al., "Controlled Growth of Monodisperse Silica Spheres in the Micron Size Range[1]," Journal of Colloid and Interface Science, Jan. 1968, pp. 62-69, vol. 26, Issue 1.
Zhao W. et al, "Covalent assembly of silica nanoparticle aggregates for oligonucleotide synthesis," Colloids and Surfaces A: Physicochem. Eng. Aspects, May 1, 2009, pp. 26-34, vol. 339, Issues 1-3.

* cited by examiner

A

B

C

D

100 nm: 0.5% by weight in ethanol, 0.25% by weight in ethanol

A

B

PROCESS FOR OBTAINING SUPERHYDROPHOBIC OR SUPERHYDROPHILIC SURFACES

CROSS REFERENCE TO RELATED APPLICATIONS

The present application is a national phase entry under 35 U.S.C. § 371 of International Application No. PCT/EP2015/061145, filed May 20, 2015, published in French, which claims the benefit of the filing date of French Patent Application No. 1454496, filed May 20, 2014, the disclosures of which are hereby incorporated herein by reference.

SUMMARY OF THE INVENTION

The present invention relates to a process for texturing surfaces which provides the latter with superhydrophobic, superoleophobic, superhydrophilic or even superoleophilic properties.

This process comprises i) a step of texturing the surface (via the deposition of nanoparticles of different sizes), ii) a step of cross-linking the surface thus textured (with a cross-linking agent), and optionally iii) a step of modifying the properties of the surface with perfluorinated (and thus hydrophobic) molecules.

This process is suitable, inter alia, for treating heat-sensitive and/or transparent surfaces and materials. Specifically, none of the steps of the process uses a temperature above 100° C. Thus, the process of the invention is particularly suitable for treating transparent surfaces consisting of non-mineral materials, such as polycarbonate, for example, as it will affect neither their transparency nor their optical properties.

DESCRIPTION OF THE PRIOR ART

A surface is said to be superhydrophobic when its surface is very difficult to wet. Such is the case for lotus, nasturtium and cabbage leaves. The same is true for duck feathers, which remain dry coming out of the water. Although the self-cleaning phenomenon associated with lotus leaves has been known in Asia for at least 2000 years, its study is rather recent.

The lotus effect is a superhydrophobicity phenomenon caused by a hierarchical roughness of the surface which is both microscopic and nanoscopic. In the case of the lotus leaf, the double structure is formed of an epidermis. The outermost layer (or cuticle) contains a layer of wax. The leaf epidermis is made up of papillae of few microns in height on which the wax rests. This wax layer is hydrophobic and forms the second component of the double structure. The latter gives the surface of the lotus leaf self-cleaning properties: water drops, as they roll off, carry dust and particles along with them.

It is possible to foresee therein the practical interest in developing such superhydrophobic surfaces: drops are thereby repelled, and the surfaces remain dry after exposure to water. Spurred on by the potential applications (self-cleaning eyeglasses, rain-repellent windshields, anti-icing coatings, stain-resistant clothing, moisture-proof paints), chemists and physicists have since the 1990s multiplied the number of processes for manufacturing such surfaces. With the emergence of nanotechnologies and the development of manufacturing tools, new processes have arisen. It is well established today that two properties are required to obtain superhydrophobic surfaces: low surface tension (chemical property), and hierarchical roughness (physical property).

Similarly, a textured surface not having a hydrophobic nature will tend to be strongly hydrophilic, even superhydrophilic (the water contact angle will consequently be close to 0°). The surface is consequently completely water-wettable. The water film created by condensation is continuous and thus generates no visual obstruction. This opens possible future applications for preventing condensation and fogging on transparent or mirror surfaces.

More precisely, to create a superhydrophobic surface with high water mobility (Cassie-Baxter non-wetting state), it is advisable to use:

i) A very rough surface, which can trap air beneath the water drops, and ii) A low surface-energy passivation layer applied to the rough texture, said layer being very thin so as not to alter the surface of the spikes.

To obtain a superhydrophilic surface, only step i) is necessary.

These two successive treatments make it possible to obtain self-cleaning and dirt-resistant surfaces, which is very important particularly when they are used outside and thus exposed to climatic conditions.

The first commercial product that mimics the lotus effect emerged in 1999 and consists of a self-cleaning exterior paint (Lotusan®). Other industrial sectors adopted this technology. Self-cleaning glass products from the company Ferro GmbH constitute another field of application: they have been installed in optical sensors located at tollgates on German highways. In turn, the company EVONIK AG has developed prototypes of lacquers and plastics.

Other applications require transparency in addition to superhydrophobicity or superhydrophilicity. Such is the case, for example, for optical equipment (windows, lenses, eyeglasses) or solar cells.

However, transparency and roughness are generally antinomic properties. Specifically, when roughness increases, transparency decreases because of light scattering caused by the surface roughness. Light scattering can be described by Rayleigh scattering or by Mie scattering according to the size of the surface roughness (assuming that roughness behaves like spherical particles). According to these well-established principles, light scattering is a function of the medium's roughness and refractive index. Therefore, only a judicious compromise between the material's roughness and refractive index makes it possible to make said material both transparent and superhydrophobic/superhydrophilic.

Several nanotexturing techniques have been described for preparing surfaces which are both transparent and superhydrophobic. In particular, nanoparticles have been proposed for controlling surface roughness in order to increase surface hydrophobicity [Deng X. et al., *Advanced Materials*. 23(26): p. 2962].

Various types of nanoparticles have been used to manufacture hydrophobic porous films ($TiO_2$, ZnO, etc.). Among these nanoparticles, those based on silica ($SiO_2$) have an adjustable size and an excellent scratch resistance. They are marketed today, and their surface can be modified by silanization. Easy to use, they are currently used for surface coating using planar surfaces or microstructured substrates thanks to several methods (spin-coating, dip-coating and spray-coating).

More precisely, superhydrophobic and transparent surfaces have been obtained by dip-coating 60 nm diameter silica nanoparticles on glass substrates treated with 3-aminopropyl triethoxysilane (APTES), followed by vacuum evaporation of perfluorodecyltriethoxysilane (PFTS) then thermal annealing (between 900° C. and 1100° C. for 30 to 120 minutes in an $O_2$ atmosphere) [Ling X. Y. et al., *Langmuir,* 2009. 25(5). p. 3260-3263]. This high-temperature annealing ensures that the coating adheres and has good mechanical stability. It is important to note that, without this high-temperature annealing, the coating can be removed easily with adhesive tape.

Another technique was developed by the team of Karunakaran et al. (*Langmuir.* 27(8). p. 4594-4602). APTES-functionalized silica nanoparticles of several sizes (100 nm, 50 nm and 20 nm) were dip-coated onto different substrates (glass, silica, epoxy and fabrics), then annealed at 200° C. or 400° C. for 2 hours, in order to enhance the adhesion and to ensure a good mechanical stability. They were then coated with PFTS by chemical vapor deposition. In this process, the thermal treatment proves to be essential, because it improves the stability of the nanoparticle coating against PDMS molding while maintaining superhydrophobicity after exposure to UV light (200 mW/cm$^2$ for 1 week) in ambient conditions. In this case, the use of APTES enables a transient affinity of the different particle populations, created by electrostatic bonds between the amine group of the APTES (positively charged) and the hydroxyl groups of the silica (negatively charged). The cohesion of the whole is then ensured by a high-temperature annealing phase.

These two techniques, however, are not suitable for transparent and heat-sensitive materials because they include a high-temperature heating step (called "annealing" above). Specifically, heating transparent heat-sensitive materials usually alters their transparency (they may crack and/or become opalescent). It is thus essential not to heat these materials when their transparency must be preserved.

Other examples use covalent grafting of particles onto each other to form so-called "raspberry" particles (i.e., consisting of an agglomeration of particles). Mention may be made of Ming W. et al. (*Nano Letters.* 5(11). p. 2298-2301) who react epoxy-functionalized particles (700 nm diameter) and amine-functionalized particles (70 nm diameter). The amine-epoxy interaction leads to the formation of a covalent bond between these particles. These particles are then included in an epoxy resin which must be partially or totally degraded to produce roughness but without ensuring mechanical resistance. Furthermore, the particles are all functionalized before deposition which leaves no silica region available for simple grafting by a covalent bond of a hydrophobic molecule such as for example a perfluorinated silane. This method thus does not meet the requirements of a transparent and strong surface.

On a similar principle, Zhao et al. (*Colloids and Surface A.* 339. p. 26-34) propose to prepare isocyanate-functionalized particles from APTES-coated silica particles. These particles consequently have a high reactivity which makes it possible to react them with another particle population and thus to form aggregates (or "raspberries"). Zhao et al. obtain large aggregates (>5 μm) from complex mixtures of organic molecules. These particles require at least two treatments to be reactive with each other. The addition of polymer makes the reactivity and the cohesion of the aggregates difficult to control.

These various techniques, which given their complexity are hard to control, are thus not compatible with the constraints inherent to industrial applications. In particular, they are not suitable for treating transparent and heat-sensitive surfaces in order to make them superhydrophilic or superhydrophobic.

The present inventors sought to develop a process making it possible to apply easily and in a lasting manner a superhydrophilic or superhydrophobic coating, in particular on a transparent and heat-sensitive material, without the risk of altering the transparency of same. This process should be simple and low cost, and contain only low-temperature steps (<180° C., preferably <100° C.). The superhydrophobic surfaces obtained by this process should nevertheless have good chemical resistance to detergents and solvents, as well as good physical resistance to abrasion and UV waves.

DESCRIPTION OF THE INVENTION

The present inventors have shown that a coating process comprising i) the successive or concomitant deposition of several nanoparticle populations of different sizes, and ii) a phase of cross-linking this layer at low temperature (<180° C., preferably <100° C.) confers superhydrophilic properties on a large number of materials (transparent or not). Moreover, the addition of a treatment with perfluorinated molecules makes it possible to transform these same surfaces into superhydrophobic and superoleophobic surfaces. Steps i) and ii) also make it possible, on their own, to confer superhydrophobic and superoleophobic properties if the particles used are themselves hydrophobic. This process is suitable, inter alia, for treating heat-sensitive surfaces since none of these steps involve heating the material or its surface at a temperature above 180° C. It can, in certain cases, even be fully carried out at room temperature. This feature is important in that it makes it possible to treat transparent surfaces consisting of non-mineral materials (such as polycarbonate, for example) without affecting the transparency of said materials or the optical properties thereof.

The term "superhydrophobic" is understood, within the meaning of the present invention, to mean a material that gives water contact angles greater than 130°, preferably greater than 140°, more preferably greater than 150°. The contact angle is measured by depositing a water drop on a planar surface of the material and measuring the angle formed by the tangent to the drop and the material.

The term "superoleophobic" is understood, within the meaning of the present invention, to mean a material that gives oil contact angles greater than 130°, preferably greater than 140°, more preferably greater than 150°. The contact angle is measured by depositing an oil drop on a planar surface of the material and measuring the angle formed by the tangent to the drop and the material.

The term "superhydrophilic" is understood, within the meaning of the present invention, to mean a material that gives water contact angles less than 10°, preferably less than 5°. The contact angle is measured by depositing a water drop on a planar surface of the material and measuring the angle formed by the tangent to the drop and the material.

The term "superoleophilic" is understood, within the meaning of the present invention, to mean a material that gives oil contact angles less than 10°, preferably less than 5°. The contact angle is measured by depositing an oil drop on a planar surface of the material and measuring the angle formed by the tangent to the drop and the material.

Generally, the process thus comprises at least i) a step of texturing the surface (via the deposition of nanoparticles of different sizes) and ii) a step of cross-linking at low temperature (preferentially at room temperature) the surface thus textured (with a cross-linking agent). When the cross-linking agent is not sufficiently hydrophobic or is hydrophilic, it is possible to add, after this cross-linking step, a step of modifying the properties of the surface using hydrophobic molecules (for example perfluorinated molecules).

In other words, the present invention relates to a process for coating surfaces comprising at least the steps:

a) Depositing at least two nanoparticle populations of different sizes on the material to be treated, and
b) Cross-linking the nanoparticle-coated surface using a cross-linking agent, at low temperature.

In a preferred embodiment, the cross-linking agent is hydrophilic (for example if TEOS is used); this process thus makes it possible to obtain superhydrophilic surfaces.

In a preferred embodiment, this process includes a third step (c) consisting in coating the surfaces obtained after steps a) and b) with perfluorinated molecules, which makes them superhydrophobic.

Advantageously, none of steps a), b) and c) of this process involve heating the surface to be treated at a temperature above 180° C.

Surfaces to be Treated

The process of the invention may be applied to the surface of a very large variety of materials.

This surface may in particular consist of a composite containing carbon (graphene, carbon nanotubes, SiC, SiN, SiP, graphite), a polymeric material, a metal, an alloy, or a metal oxide. Moreover, it may be a composite of polymeric organic materials and of inorganic materials. It may also be applied to organic materials such as wood or cotton.

More particularly, this surface may be made of steel, stainless steel, indium tin oxide (ITO), zinc, zinc sulfide, aluminum, titanium, gold, chromium or nickel. Alternatively, this surface may consist of silicon, aluminum, germanium or oxides thereof or alloys thereof such as, for example, quartz, borosilicate glass such as BK7, or soda-lime glass. It may also consist of polycarbonate (PC), polyethylene terephthalate (PET), polymethyl methacrylate (PMMA), polystyrene, polyethylene (PE), polypropylene (PP), polylactic acid, polyglycolic acid, polyester, polyacrylic acid (PAA), polyacrylate, polyacrylamide (PAM), polyalkyl acrylate (polymethyl acrylate (PMA), polyethyl acrylate (PEA), polybutyl acrylate (PBA)), polymethacrylic acid (PMA), polymethacrylate, polytetrafluoroethylene (PTFE), or polyvinylidene fluoride (PVDF). These various polymeric materials may be present in mixture or in copolymer form.

In a preferred embodiment, the process of the invention is applied to a surface consisting of at least 50%, preferably at least 75%, of silica, aluminum, germanium, oxides thereof or alloys thereof. Ideally, it is a surface consisting of 100% of these compounds. In a preferred embodiment, the surface is transparent and consists of glass or silica or polycarbonate.

In a more preferred embodiment, the process of the invention is applied to a surface consisting of a heat-sensitive material.

The term "heat-sensitive material" is understood, in the present invention, to mean a material whose structure, appearance or mechanical, optical, physical or chemical properties are altered when it is heated at a temperature above 180° C.

Examples of heat-sensitive materials include certain polymeric materials containing compounds such as polycarbonates, polymethyl methacrylate (PMMA), polypropylene, polyvinyl acetate (PVA), polyamides (PA), polyethylene terephthalate (PET), polyvinyl alcohols (PVA1), polystyrenes (PS), polyvinyl chlorides (PVC) and polyacrylonitriles (PAN), the properties of which (solidity, transparency, mechanical resistance, etc.) are altered when they are heated at temperatures higher than 180° C.

In an even more preferred embodiment, the process of the invention is applied to a material containing more than 50% of polycarbonate or polycarbonate composites coated with $SiO_x$ groups.

Activation/Pretreatment of the Surface to be Treated (Optional)

Activating a surface consists in making a material wettable and reactive even though it is initially inert with respect to the superhydrophilic or superhydrophobic layer which is to be grafted.

On polymeric surfaces such as for example polyethylenes, polypropylenes, polyurethanes, PMMA or polycarbonates, activation may be obtained by an ionizing treatment such as a UV-ozone, plasma or corona treatment that creates free radicals on the surface and inserts high-energy groups such as hydroxyl groups. These groups are consequently favorable to interaction with the superhydrophilic or superhydrophobic coatings described elsewhere in this document.

In a preferred embodiment, the material to be coated (or surface to be treated) is activated by a physical treatment such as for example UV-ozone treatment or plasma treatment. The conditions of these treatments are well-known to persons skilled in the art (see Example 14). This activation step is especially important when the surface consists of polymers, such as those described above.

This physical activation step is not essential when the surface to be coated consists of inorganic materials or of metals such as those described above.

Moreover, certain surfaces to be coated may be advantageously pretreated with an adhesion agent prior to steps a) and b).

In the context of the present invention, an "adhesion agent" is an organic chemical compound that enables the creation of a strong interaction, for example such as a covalent bond, between the surface and the different nanoparticles which will be deposited thereon. Such adhesion agents are for example dissymmetrical organic molecules bearing two functional groups making it possible to react sequentially with the particles. Said adhesion agents are preferably organic monomer compounds comprising:

1) surface adhesion functional groups (according to the type of surface to be treated, this group may be for example a silane, a phosphonate or a thiol), and
2) functional groups ensuring that the surface has affinity for the nanoparticles, such as for example a reactive chemical group enabling the formation of covalent bonds.

Preferably, the adhesion agents usable for pretreating the surfaces in the process of the invention are silane isocyanate compounds, among which mention may be made of 3-(trimethoxysilyl) propyl isocyanate (TMS-NCO) and 3-(triethoxysilyl)propyl isocyanate. Mention may also be made of silane epoxide compounds such as for example 3-glycidoxypropyltrimethoxysilane (GPTMS) or 3-glycidoxypropyltriethoxysilane.

Such adhesion agents may be used when the surfaces to be treated are for example made of silicon, silica, glass, germanium, organic polymers, metal, alloy or metal oxide.

Contrary to that proposed by various teams, it is preferable not to coat the surface of interest with amine compounds such as aminoalkyl silane compounds (among which are 3-aminopropyl triethoxysilane (APTES), 3-aminopropyl trimethoxysilane (APTMS), 4-aminobutyl triethoxysilane (ABTES), 3-aminopropyl tri-isopropoxysilane (APTiPrS), or 3-aminopropyl trichlorosilane (APTCS)). It is also preferable not to coat the surface of interest with cationic polymers (such as polylysine, polyalkylamine hydrochloride or poly(N-vinylimidazole)). In fact, all these compounds create weak bonds with the nanoparticles which will be then added, these weak bonds being harmful to the layer's stability and resistance (see Example 12).

It should be noted that, in the case of a silica surface, it is possible not to use any adhesion agent. If an adhesion agent is used, however, it will preferentially be an agent for forming covalent bonds so as to increase the interaction between the particles and a surface.

To increase the interactions of the superhydrophobic or superhydrophilic coating with the material, an adhesion primer layer may also be used. This primer layer may be deposited optionally in addition to activation by a physical treatment. The expression "adhesion primer layer" is understood to mean the deposition of a uniform layer of a transition metal alkoxide such as for example tetra ethoxy silicate (TEOS). To facilitate this deposition, a surface may first be activated by an ionizing treatment such as for example plasma or UV-ozone treatments (see Example 20).

This adhesion primer layer is especially important when the surface to be coated is polymeric.

More precisely, it is advantageous, when the surface of interest consists of polymeric materials, to combine the two types of pretreatments, i.e., to apply a physical pretreatment (UV, ozone or plasma) and an adhesion primer layer (with TEOS for example). Preferably, the deposition of the adhesion primer layer takes place after the physical pretreatment.

When the surface of interest consists of an inorganic or metallic material, it is not necessary to activate it, either by a physical treatment or by an adhesion primer layer. Moreover, it is not necessary to treat this type of surface with an adhesion agent as defined above. These various treatments are thus optional (on this type of surface).

It is advisable in all cases to make sure that the surface is clean. If need be, a cleaning/washing step may be added to the process of the invention.

In a preferred embodiment, a physical activation of the surface is carried out. It is followed by the deposition of an adhesion primer layer. This adhesion primer is preferably an acidic TEOS solution. In this preferred embodiment, the TEOS solution is prepared in water, alcohol or a mixture of these liquids, at a concentration between 1 mM and 1000 mM, more preferentially between 10 mM and 500 mM, and even more preferentially between 50 mM and 250 mM. The deposition of this primer layer may be carried out by dip-coating or by spray.

Nanoparticle Populations

The first step of the process of the invention consists in depositing at least two nanoparticle populations of different sizes on the surface to be treated.

The term "nanoparticle" (or NP) is understood, within the meaning of the invention, to mean spherical solid particles of very small size, typically nanometer- to micrometer-size. More precisely, the "nanoparticles" usable in the process of the invention have an average diameter between 1 nm and 10 μm.

The expression "nanoparticle population" is understood, within the meaning of the present invention, to mean a set of nanoparticles of the same size or of similar size, i.e., having the same shape and a homogeneous size. In practice, the diameter of the nanoparticles within the same population follows a Gaussian distribution which may vary by at most 30%.

The two nanoparticle populations may be deposited successively (or sequentially) on the surface to be treated, or concomitantly. In the second case, they may first be agglomerated, generating larger nanoparticles called "raspberries" which will then be deposited on the surface. Raspberries may also be formed directly on the surface to be treated, when the two populations are added successively or concomitantly.

These "raspberry" nanoparticles consist of large nanoparticles on the surface of which smaller nanoparticles are grafted (preferably in a single layer). They thus consist of two nanoparticle populations within the meaning of the present application. These nanoparticle assemblies are the source of the nanometer scale roughness created on the surface. This roughness provides superhydrophilic properties or even superhydrophobic properties (if the rough surface is then treated with a hydrophobic compound).

These "raspberry" nanoparticles are obtained using at least two distinct sizes of nanoparticles. It is thus essential, in the context of the present invention, to use two categories of nanoparticles having distinct sizes (one substantially larger than the other).

In a preferred embodiment, the nanoparticles used in the process of the invention have diameters between 1 nm and 10 μm, more preferentially between 5 nm and 1 μm, and even more preferentially between 10 nm and 500 nm. Ideally, the diameters of the particle populations have a ratio between 2 and 30, and preferably a ratio between 3 and 10. This ratio corresponds to the ratio of the diameter of the large particles to the diameter of the small particles.

For applications on transparent surfaces using wavelengths in the visible and/or infrared range, the nanoparticles used in step a) will have a preferred diameter between 10 and 200 nm. Ideally, the diameters of the nanoparticle populations have a ratio between 2 and 30, and preferably have a ratio between 3 and 10. This ratio corresponds to the ratio of the diameter of the large nanoparticles to the diameter of the small nanoparticles.

In a most preferred embodiment, one of the two nanoparticle populations used in the process of the invention has a diameter between 50 and 200 nm, and the other a diameter between 5 and 50 nm.

While monodisperse nanoparticle populations are preferred, polydisperse nanoparticles may also be used.

The term "monodisperse" is understood to mean particles having a diameter whose variation does not exceed 10%. For example, a population of 50 nm diameter particles will be regarded as monodisperse if the diameters of the particles within this population are 50 nm±10%, i.e., between 45 and 55 nm.

The term "polydisperse" is understood to mean all other cases, namely particle populations the diameter of which varies by more than 10%, or a mixture of two monodisperse populations.

By way of example, the inventors present below results obtained using two polydisperse nanoparticle populations, one having a diameter between 70 and 100 nm and the other a diameter between 10 and 15 nm.

The nanoparticles used in the process of the invention may consist of different materials. Among these, mention may be made of:

- inorganic materials (such as silicon, aluminum, titanium, zinc, germanium and/or oxides thereof, for example),
- metals, alloys, oxides and ceramics or composites containing carbon, and
- polymers, among which are: polycarbonate, polyethylene terephthalate (PET), polymethyl methacrylate (PMMA), polystyrene, polyethylene, polyester, polyacrylic acid (PAA), polyacrylate, polyacrylamide (PAM), polyalkyl acrylate (polymethyl acrylate (PMA), polyethyl acrylate (PEA), polybutyl acrylate (PBA)), polymethacrylic acid (PMA), latex and polymethacrylate.

The nanoparticles may also consist of a single compound or an alloy of several compounds of different nature.

The two nanoparticle populations of different sizes may consist of different materials (silica and polycarbonate, for example). However, in a preferred embodiment, the two nanoparticle populations of different sizes consist of the same material (silica or polycarbonate, for example).

For applications in which the transparent properties must be maintained after treatment, nanoparticles the refractive index of which is close to that of the material to be coated will be preferred.

In a preferred embodiment, said nanoparticles are made of the same material as the surface to be coated. Thus, they preferably consist of silica, aluminum, titanium, germanium, oxides thereof or alloys thereof, or polycarbonate.

Successive Deposition of Nanoparticles

In a preferred embodiment, the first nanoparticle layer deposited on the surface has not been coated or will not be coated with any adhesion agent.

In another embodiment, the first nanoparticle layer deposited has been coated or will be coated with an adhesion agent for increasing the affinity of the particles with the surface and/or of the nanoparticles with one another. Said adhesion agent is an organic chemical compound that creates a strong interaction, for example such as a covalent bond, between the different nanoparticles that will be deposited on the surface of said material. This agent must, on its own, have a strong interaction with the nanoparticles.

Such adhesion agents are for example dissymmetrical organic molecules bearing two functional groups making it possible to react sequentially with the particles.

Such adhesion agents are for example silane isocyanate compounds, among which mention may be made of 3-(trimethoxysilyl)propyl isocyanate (TMS-NCO) or 3-(triethoxysilyl)propyl isocyanate. Mention may also be made of silane epoxide compounds such as for example 3-glycidoxypropyltrimethoxysilane (GPTMS) or 3-glycidoxypropyltriethoxysilane.

In a preferred embodiment, the nanoparticles are made of silica and the adhesion agent deposited on the surface thereof is GPTMS or TMS-NCO (see Examples 12 and 18).

Contrary to that proposed by various teams, it is preferable not to coat the nanoparticles used in the process of the invention with amine compounds such as aminoalkyl silane compounds (among which are 3-aminopropyl triethoxysilane (APTES), 3-aminopropyl trimethoxysilane (APTMS), 4-aminobutyl triethoxysilane (ABTES), 3-aminopropyl triisopropoxysilane (APTiPrS) or 3-aminopropyl trichlorosilane (APTCS)). It is also preferable not to coat the nanoparticles used in the process of the invention with cationic polymers (such as polylysine, polyalkylamine hydrochloride or poly(N-vinylimidazole)). Indeed, all these compounds create weak bonds that will decrease the layer's stability (see Example 12 and 18).

In a preferred embodiment, step a) of the process of the invention thus comprises at least the sub-steps:

a0) Optionally, surface activation by a physical treatment (such as for example UV-ozone treatment or plasma treatment) optionally followed by the deposition of an adhesion primer layer (such as TEOS, for example), a1) Optionally, surface treatment with an adhesion agent selected for example from TMS-NCO, 3-(triethoxysilyl)propyl isocyanate, GPTMS or 3-glycidoxypropyltriethoxysilane, a2) Deposition of a first nanoparticle population on the surface to be treated, a3) Optionally, treatment of the surface coated with the first nanoparticle population with an adhesion agent selected for example from TMS-NCO, 3-(triethoxysilyl)propyl isocyanate, GPTMS or 3-glycidoxypropyltriethoxysilane, a4) Deposition of a second nanoparticle population of a size different from those used in step a2).

Step a2) is preferably carried out several times, i.e., between 2 and 10 times, more preferably between 2 and 6 times.

The nanoparticles used in steps a2) and/or a4) may alternatively be coated with said adhesion agent before they are contacted with the surface. In this case, steps a1) and a3) are unnecessary.

In a preferred embodiment, the surface treatment with an adhesion agent during steps a1) and/or a3) is carried out either by evaporation or by sol-gel deposition.

In the case of an "evaporation", the surfaces (optionally coated with the nanoparticles according to whether step a1 or a3 is concerned) may be placed in an enclosure under reduced pressure in the presence of an adhesion agent. In this case, the reaction time is advantageously comprised between 1 minute and 24 hours, preferentially between 5 minutes and 10 hours, even more preferentially between 10 minutes and 2 hours. The pressure within the enclosure is, for example, between 1 and 100 mbar, preferentially between 5 and 30 mbar.

In the case of a "sol-gel deposition", the adhesion agents may be dissolved in a suitable solvent, such as for example an alcohol, at a concentration between $10^{-5}$ mol/L and 1 mol/L, preferentially between $10^{-3}$ and $10^{-1}$ mol/L. This solvent is consequently preferentially methanol, ethanol or isopropanol. In all cases, it is preferable that it is anhydrous. Preferentially, said adhesion agent is GPTMS or TMS-NCO. The surface may be immersed in the solution for 1 to 60 minutes, then rinsed with the solvent and optionally heated for 15 minutes at 60° C. or at least 1 hour at room temperature.

It should be noted that these operations in no way require heating the surfaces above 100° C.

In another preferred embodiment, the particles are deposited on surfaces of the same type by soaking the surface several times in the same solution (or suspension) containing the nanoparticles.

In a preferred embodiment, the nanoparticles deposited first (step a2) have a diameter comprised between 70 and 200 nm, and the nanoparticles deposited second (step a4) have a diameter comprised between 5 and 50 nm. In a preferred embodiment, the nanoparticles deposited first (step a2) have a diameter comprised between 70 and 100 nm, and the nanoparticles deposited second (step a4) have a diameter comprised between 10 and 15 nm (see examples below).

In a preferred embodiment of the process of the invention, it is possible to deposit at least three nanoparticle populations of different sizes, or more (four or five). In this case, the protocol for preparing the surface and the coating thereof (steps a0) to a4) indicated above) will be repeated as many times as necessary, i.e., by repeating, as many times as necessary, the steps of the deposition of an adhesion agent followed by the deposition of a new particle population.

In an even more preferred embodiment, the surface to be treated is made of silica, the nanoparticles deposited in steps a1) and a3) are made of silica and the adhesion agent deposited between the two nanoparticle layers (step a2) is TMS-NCO.

In a preferred embodiment, it is possible to add the deposition of a cross-linking agent during or after steps a2) and a4) (Examples 4 and 6).

Preparation and Deposition of "Raspberry" Particles

In another particular embodiment of the invention, "raspberry" nanoparticles may be prepared before being contacted with the surface to be treated. In this case, the protocol is the following:

a'1) Coating a first nanoparticle population with an adhesion agent, a'2) Contacting this first population with one or more other nanoparticle population(s) so as to form raspberry particles, a'3) Optionally, purifying the raspberry particles thus formed, a'4) Depositing the "raspberry" nanoparticles on the surface to be treated, said surface having been optionally activated and/or pretreated as described above.

Optionally, the nanoparticles obtained after step a'3) may be treated again with an adhesion agent as during step a'1), then contacted with one or more other nanoparticle populations as during step a'2) and optionally re-purified, as during step a'3). These operations may be repeated as many times as necessary in order to obtain raspberry nanoparticles of the desired size and roughness.

The nanoparticle populations and the adhesion agent used to form these raspberry nanoparticles may be as previously described.

In particular, said adhesion agent is preferably a silane isocyanate compound (TMS-NCO or 3-(triethoxysilyl)propyl isocyanate) or a silane epoxide compound (GPTMS or 3-glycidoxypropyltriethoxysilane). Preferably, said adhesion agent is not aminated (in particular, it is not APTES), because amination of the nanoparticles makes the coating fragile.

It should be noted that it is also possible to obtain raspberry nanoparticles by the method of Stober et al. (*J. Colloids and Interface Sciences.* 26. p. 62) by inducing the synthesis of small particles on the surface of large ones by growth of a $SiO_x$ layer (TEOS-based).

In a preferred embodiment, the treatment of the nanoparticles with an adhesion agent during step a'1) is carried out either by evaporation, or by spraying a solution, or by soaking in a solution.

The evaporation protocol is the same as for the surfaces, described above. Briefly, the nanoparticles may be placed in an enclosure under reduced pressure in the presence of an adhesion agent, for 1 minute to 24 hours, preferentially for 5 minutes to 10 hours, more preferentially for 10 minutes to 2 hours, the pressure in the enclosure being for example between 1 and 100 mbar, preferentially between 5 and 30 mbar.

In the case of a reaction in solution, the adhesion agent may be dissolved in a suitable solvent, such as for example toluene, at a concentration between $10^{-5}$ mol/L and 1 mol/L, preferentially between $10^{-3}$ and $10^{-1}$ mol/L. In all cases, it is preferable that said solvent is anhydrous. Preferentially, the adhesion agent is TMS-NCO. The large nanoparticles may then be immersed in the solution containing the adhesion agent for 1 to 24 hours, then rinsed with the solvent and heated under vacuum for 4 hours at 50° C.

These nanoparticles may then be resuspended in a suitable solvent, such as for example toluene. To this suspension the second nanoparticle population is added, the quantity of which preferably respects the ratio N described below. This mixture may be dispersed ultrasonically and heated at reflux overnight.

The ratio N allowing the small nanoparticles to fully coat the larger nanoparticles (in a single layer) preferentially has the following formula:

$$N = \frac{\pi(R2 + R1)2}{R22}$$

Where R1 is the radius of the large nanoparticles and R2 is the radius of the small nanoparticles.

In a preferred embodiment, a ratio of at least N small nanoparticles per large nanoparticle is added in order to prepare the raspberry nanoparticles. In other words, in this embodiment, N times more small nanoparticles than large nanoparticles are added.

Optionally, a purification step may be required when the small nanoparticles have been added in excess relative to the nanoparticles of larger diameter. In this case, the purification removes the unbound small nanoparticles so that they do not interfere with the deposition of the raspberry nanoparticles on the surfaces.

It may also be useful to purify the raspberry nanoparticles when they have been formed in a solvent that is not that used to carry out the surface deposition. In this case, it is possible to dry the raspberry nanoparticles in order to redisperse them in another solvent.

The purification step a'3) may, for example, be implemented by filtering or by centrifuging the raspberry nanoparticles formed. A change of solvent between the preparation of the raspberry nanoparticles and the deposition thereof may also be envisaged. The nanoparticles are consequently dried by evaporation of the solvent before being dispersed in a solvent favorable to deposition (see below).

The raspberry nanoparticles constituted beforehand may then be deposited on the surface to be treated (optionally first treated by a physical treatment and/or with an adhesion agent or TEOS, as described above).

In a particular embodiment, the process of the invention consequently contains at least the steps:

a"0) Optionally, activating and pretreating the surface to be treated as described above, a"1) Preparing "raspberry" nanoparticles according to the process described above, a"2) Depositing the "raspberry" nanoparticles on the surface to be treated, b) Cross-linking the surface coated with the raspberry nanoparticles using a cross-linking agent, at low temperature.

In a particular embodiment, the process of the invention may contain an additional step, after step b), consisting in coating the cross-linked surface with unassembled nanoparticles. These additional nanoparticles are then preferably cross-linked themselves, step b) thus being repeated (see Examples 12, 16 and 18).

These unassembled nanoparticles may be of any size (small or large). Preferably, they have an average diameter comprised between 1 and 150 nm, more preferably comprised between 5 and 80 nm. It should be noted that, if the surface to be treated must remain transparent, NPs larger than 150 nm must not be used.

The raspberry nanoparticles and the unassembled nanoparticles may be deposited in a sequential or simultaneous manner on the surfaces, in order to improve the performance characteristics of the coating (see Example 12, Protocol 2).

Steps a"1) and a"2) described above may be carried out in a concomitant manner (the raspberry particles are consequently formed directly on the surface) and/or in a repeated manner.

Deposition of Isolated Nanoparticles or Raspberry Nanoparticles on the Surface

The deposition of the nanoparticles on the surface to be treated (in the form of distinct populations or of raspberry particles) may be carried out by dip-coating, spin-coating, spray, flow-coating or wiping.

The term "dip-coating" is understood to mean a means of deposition where the surface to be treated is immersed and then withdrawn from a solution/suspension at a defined speed (L. D. Landau, V. G. Levich, *Acta physicochimica*, USSR, 17, (1942), 42).

The term "spin-coating" is understood to mean a means of deposition where a solution/suspension is deposited on the surface to be coated. This same surface is attached to a spinner which turns the surface at a controlled speed thus allowing the solution/suspension to spread over the surface and to wet the totality of the surface (D. Meyerhofer, *J. Appl. Phys.,* 49, (1978), 3993).

The term "spray" is understood to mean a means of deposition where the solution/suspension is projected in fine droplets onto the surface using a means of propulsion such as for example a gas. The vaporized mixture is projected onto the surface in order to wet the totality thereof.

The term "flow-coating" is understood to mean a means of deposition where the solution/suspension is poured onto the surface to be coated in order to wet the totality thereof.

The term "wiping" is understood to mean a means of deposition whereby a fabric, paper or brush, impregnated with the solution/suspension to be deposited, is applied to the surface to be treated. The fabric or paper is then wiped so as to wet the totality of the surface.

In a particular embodiment, the particles (isolated or raspberries) are deposited on the surfaces by dip-coating at a speed comprised between 1 and 500 mm/min, preferably between 5 and 150 mm/min with a stationary soaking time comprised between 0 and 300 minutes. Preferably, the deposition is carried out at room temperature and produces layer thicknesses comprised between 50 and 1000 nm, and preferably between 100 and 500 nm. Preferably, the dip-coating operations are repeated at least twice, up to ideally 5 times, in order to enhance the resistance of the coating (without affecting the transparency of the material).

In another particular embodiment, the particles (isolated or raspberries) are deposited by spray on the surfaces to be coated. Advantageously, it is sufficient to proceed only once with this operation to obtain a resistant superhydrophilic or superhydrophobic coating (see Examples 15 and 19).

It should be noted that these operations in no way require heating the surfaces above 100° C.

To carry out these coating operations, the nanoparticles are preferably dispersed in a solvent, constituting a "suspension". Any type of solvent may be used to implement these various protocols. It is important to note that no solubilization is required, because the nanoparticles are in suspension in the solvent concerned. The solvent must nevertheless make it possible to wet the material to be coated properly, which is the case with most of the liquids conventionally used for coating surfaces.

Nevertheless, the inventors noted that, in certain cases, the choice of solvent influences the coating efficiency and the roughness obtained (see Example 4). Thus, in a preferred embodiment, the solution containing the nanoparticles is an aqueous solution or an alcoholic solution. In an even more preferred embodiment, the nanoparticles are suspended in a solvent selected from: water, methanol, ethanol, isopropanol, propan-1-ol, butan-1-ol, butan-2-ol, tert-butanol and mixtures thereof.

In a most preferred embodiment, the nanoparticles are suspended in ethanol, isopropanol, methanol, propan-1-ol, butan-1-ol, butan-2-ol or tert-butanol.

Furthermore, it arises from the experiments carried out by the inventors that a better surface roughness is obtained by dip-coating when the mass concentration of the nanoparticles is comprised between about $10^{15}$ and $10^{19}$ particles per liter, preferably between about $2 \cdot 10^{15}$ and $7 \cdot 10^{18}$ particles per liter, for one or the other of the nanoparticle populations.

In a particular embodiment, the nanoparticle concentration is of 0.5% (m/v) for 100 nm particles, and 0.25% (m/v) for 15 nm particles (see Example 3).

In a particular embodiment, the deposition is carried out by spray or by electrospray. In this embodiment, the nanoparticles are suspended in a polar solvent (preferably an alcohol), at a nanoparticle concentration comprised for example between $10^{15}$ and $10^{19}$ nanoparticles per liter, whether the nanoparticles are deposited sequentially or simultaneously on the surface.

Step b): Cross-Linking the Nanoparticle-Coated Surface

The second step of the process of the invention consists in cross-linking the nanoparticle-coated surface using a cross-linking agent, at low temperature.

The expression "low temperature" is understood to mean here a temperature that does not exceed 180° C. Preferably, this temperature is comprised between 10° C. and 180° C., even between 10° C. and 100° C.

In the context of the invention, the cross-linking step is carried out preferentially at a temperature below 180° C., and preferably below 100° C. This makes it possible to apply the process of the invention to the heat-sensitive surfaces described above.

In an even more preferred embodiment, the cross-linking takes place without having to heat the treated surface. In this case, it is thus carried out at room temperature (or between 15° C. and 30° C.). This cross-linking may be initiated by thermodynamic or radical means.

As shown in the examples below, it is possible, thanks to the process of the invention, to obtain very resistant superhydrophilic or superhydrophobic layers without needing to heat the surfaces to be treated. This very important feature distinguishes the process of the invention from the processes disclosed in the prior art.

This cross-linking step binds the particles to the surface, and binds the various particles to each other. This makes the superhydrophilic or superhydrophobic treatment of the invention durable and resistant to mechanical and chemical stresses (see Examples 4, 6 and 7).

More precisely, this step consists in contacting the surface coated with nanoparticles or with raspberry nanoparticles with a cross-linking agent. This contacting may be sequential (first the nanoparticles, then the cross-linking agent, see Examples 10 and 15) or concomitant. In the second case, it is advisable to prepare a mixture containing the nanoparticles or the raspberry nanoparticles and the cross-linking agent (see Examples 16 to 19).

It should be noted that it is possible to add the cross-linking agent after each deposition of nanoparticles, alternately (see Example 10), or only at the end of the process, after all the nanoparticles have been deposited (see Example 4).

By dip-coating, the thickness of the cross-linking agent layer is linked to the duration of this contacting. Care must thus be taken that this contacting does not promote smoothing of the surface (which must remain rough).

The cross-linking agents usable in the context of the invention may consist of the same element as the nanoparticles, such as Ti alkoxides (for example tetra-n-butyl titanate) or Si alkoxides (for example tetraethyl orthosilicate, or "TEOS"). Mention may also be made of zirconium alkoxides, aluminum alkoxides and, more generally, transition metal alkoxides. In a preferred embodiment, the cross-linking agent is TEOS.

The deposition of said cross-linking agent is carried out for example by dip-coating at a speed comprised between 5 and 100 mm/min, with a stationary soaking time comprised between 0 and 300 minutes.

In a preferred embodiment, the cross-linking agent (for example TEOS) is contained in an aqueous or alcoholic solvent (preferably ethanol, isopropanol or methanol), or in a water/alcohol mixture (preferably water/ethanol).

In another preferred embodiment, the cross-linking agent (for example TEOS) is deposited by spray in an aqueous or alcoholic solvent (preferably ethanol, isopropanol, methanol, butan-1-ol or tert-butanol), or in a water/alcohol mixture (preferably water/ethanol or water/tert-butanol).

When the deposition of TEOS is carried out in an acidic medium (7>pH>0), hydrolysis is faster than condensation (see Brinker C. J. et al., Thin Solid Films, Elsevier, 201 (1991) 97-108), which releases all the monomers for rapid formation of small nanoparticles (polyhedral units of a few tens of atoms) the size of which does not exceed a nanometer. These nanoparticles then aggregate to form low-density branched polymeric clusters which aggregate in turn. These clusters remain in suspension without precipitating: this is the "sol". The clusters gradually occupy an increasingly large volume fraction up to a value close to 1. The viscosity of the medium consequently becomes high and the liquid ultimately solidifies: this is gelation. Macroscopically, this assembly is completed by the appearance of a solid-type rigidity and elasticity, coming from the "gel". Solid and transparent, the gel obtained thus consists of a polymeric network of silica confining the solvent and possibly the clusters still in solution. This network has a porosity the distribution of which ranges from the size of the nanoparticles to that of the clusters. Beyond the gelation, the chemical reactions continue and modify the size distribution of the gel pores.

When the TEOS-containing medium is neutral or mildly basic, the condensation of the silicon-containing species is faster than the hydrolysis, and consequently the polymer is gradually supplied with monomers. The step of forming elementary units is a monomer-cluster aggregation the kinetics of which is limited. This mechanism leads to the formation of dense silica nanoparticles. The latter, which may reach several hundreds of nanometers in size, are negatively charged. The resulting electrostatic repulsions prevent a new aggregation between the nanoparticles that remain in suspension in the solvent. The nanoparticles-solvent unit constitutes the "sol". Aggregation between nanoparticles leads to gelation as for the acid system. Finally, in very basic medium (pH>11), depolymerization (rupture of siloxane bridges) prevails and the silica is transformed into soluble silicate.

The present inventors observed that this nanoparticle assembly prepared in neutral or basic medium is surprisingly less stable than when the cross-linking is carried out in acidic medium (see Example 6).

In a preferred embodiment, the TEOS is thus deposited at acidic pH (i.e., at pH<7, preferably at pH<6) to promote the stability and the resistance of the layer thus formed.

In an even more preferred embodiment, the TEOS is contained in an aqueous or alcoholic medium (for example a water/ethanol mixture) having a pH comprised between 1 and 5, preferably between 1 and 3, preferably equal to 2.

In another even more preferred embodiment, the TEOS used to cross-link the nanoparticles is at a concentration comprised between 1 and 30 mM, preferably between 5 and 24 mM, and most preferably is 10 mM.

In a preferred embodiment, the steps of depositing the nanoparticles (raspberry or not) and of depositing the cross-linking agent are concomitant, because the surface is contacted with a mixture containing the particles and the cross-linking agent.

In a specific case, the nanoparticles within this mixture are raspberry nanoparticles preferentially having a concentration comprised between $10^{15}$ and $10^{18}$ NPs per liter of a TEOS/HCl/EtOH/$H_2O$ solution in a ratio of 1:x:y:z. In this case:

- x will be comprised between 0.1 and 10, preferentially between 1 and 5,
- y will be comprised between 0 and 5000, preferentially between 1 and 1500,
- z will be comprised between 0 and 5000, preferentially between 1 and 1500.

In another specific case, said mixture contains NP100 and NP15 nanoparticles which are suspended at concentrations comprised between $10^{15}$ and $10^{18}$ (NP100) and between $10^{18}$ and $10^{21}$ (NP15) per liter of a TEOS/HCl/EtOH/$H_2O$ solution in a ratio of 1:x:y:z. In this case:

- x will be comprised between 0.1 and 10, preferentially between 1 and 5,
- y will be comprised between 0 and 5000, preferentially between 1 and 1500,
- z will be comprised between 0 and 5000, preferentially between 1 and 1500.

Step c) (optional): Coating the Textured Surfaces with a Hydrophobic Agent

In a particular embodiment, the process of the invention contains a final step consisting in coating the textured surface with a layer of hydrophobic organic molecules which will make the surface superhydrophobic.

This step is required when a superhydrophobic surface is to be produced and when the nanoparticles used are made of silica and the cross-linking agent is a Ti/Si alkoxide.

The deposition of these hydrophobic organic molecules may be carried out by dip-coating, by spin-coating, by evaporation techniques well-known to persons skilled in the art (PVD, CVD), by spray, or even by wiping.

In a preferred embodiment of the invention, these hydrophobic organic molecules may be hydrogenated polymers, for example polyethylenes (PE) or polystyrenes (PS). These molecules may also be totally or partially fluorinated polymers such as for example polytetrafluoroethylene (PTFE), polyvinylidene fluoride (PVDF), or perfluoropolyethers (PFPE).

In another embodiment, it is also possible to use, as a hydrophobic agent, a molecule bound by a radical reaction on the surface to be treated. This molecule may for example be an aryl diazonium having a hydrophobic chain. The aryl group reacts with the surface via free radicals. This molecule consequently leaves its perfluorinated, fluorinated or alkyl chain available to make the surface hydrophobic.

In another preferred embodiment of the invention, these molecules may be monomeric in nature in order to enable their arrangement into a self-assembled monolayer. In this case, their general formula will be A-B-C, wherein:

A is a group promoting the adhesion of the layer on the surface,

B is a linker, and

C is a functional group providing a hydrophobic and or oleophobic property to the layer formed.

In a preferred embodiment, group A is selected from:

a) a silane group of formula:

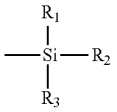

wherein $R_1$, $R_2$, and $R^3$ independently represent a chlorine, bromine or iodine atom, a hydroxyl group (OH), a $C_1$-$C_{10}$ alkoxy group (O-Alk), such as methoxy (—O—$CH_3$), ethoxy (O—$C_2H_5$) or isopropoxy (—O—$C_3H_7$);

wherein, preferably, $R_1$, $R_2$, and $R^3$ are identical and represent an alkoxy group, b) a thiol group of formula —SH, or c) a phosphonate group of formula:

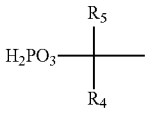

wherein:

$R_4$ is a hydrogen atom (H), a fluorine atom (F) or an OH group, and $R_5$ is a hydrogen atom (H), a fluorine atom (F) or a $PO_3H_2$ group.

In a preferred embodiment, group B is an L-M group where:

L is a $(CH_2)_m$—X— group, m being an integer between 0 to 100, preferably comprised between 0 and 30, and X being a perfluorinated or partially fluorinated, optionally saturated $C_0$-$C_{100}$ alkyl group, the alkyl chain of which may be substituted or interrupted by 0 to 10 cycloalkyl or aryl groups which may be optionally perfluorinated; X may also be a single covalent bond, an —(O—$CH_2$—$CH_2$)$_{m'}$, —(O—$CH_2$—$CH_2$—$CH_2$)$_{m'}$, —(O—$CH_2$—CH($CH_3$))$_{m'}$ or —(O—CH($CH_3$)—$CH_2$)$_{m'}$ group, m' being an integer comprised between 0 and 100, preferably between 0 and 50, and M is selected from:

a) a single chemical bond, an oxygen atom (O), a sulfur atom (S), or an S(CO), (CO)S, or NR, (CO)NR or NR(CO) group, R being a hydrogen atom or a $C_1$-$C_{10}$ alkyl, or b) the following groups:

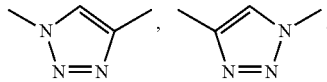

In a preferred embodiment, group C is selected from a hydrogen atom, —(CF($CF_3$)$CF_2$O)$_n$—$CF_2$—$CF_2$—$CF_3$, —($CF_2$CF($CF_3$)O)$_n$—$CF_2$—$CF_2$—$CF_3$, —($CF_2CF_2CF_2$O)$_n$—$CF_2$—$CF_2$—$CF_3$, —($CF_2CF_2$O)$_n$$CF_2$—$CF_3$, —CF($CF_3$)—O—(CF($CF_3$)$CF_2$O)$_n$—$CF_2$—$CF_2$—$CF_3$, —CF($CF_3$)—O—($CF_2$CF($CF_3$)O)$_n$—$CF_2$—$CF_2$—$CF_3$, —CF($CF_3$)—O—($CF_2CF_2CF_2$O)$_n$—$CF_2$—$CF_2$—$CF_3$, —$CF_2$—O—($CF_2CF_2$O)$_n$—$CF_2$—$CF_3$ or $C_pF_{2p+1}$, wherein n and p are integers comprised between 1 and 100, preferably between 1 and 50.

In an even more preferred embodiment, these hydrophobic molecules have a formula A-B-C wherein:

a) A is a silane group of formula:

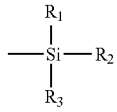

wherein $R_1$, $R_2$, and $R_3$ independently represent a chlorine, bromine or iodine atom, a hydroxyl group (OH), a $C_1$-$C_{10}$ alkoxy group (O-Alk), such as methoxy (—O—$CH_3$), ethoxy (O—$C_2H_5$) or isopropoxy (—O—$C_3H_7$);

b) B is an L-M group where:

L is a $(CH_2)_m$—X— group, m being an integer comprised between 0 to 100, preferably between 1 and 30, more preferably between 1 and 10, and M is an NR, (CO)NR or NR(CO) group, R being a hydrogen atom or a $C_1$-$C_{10}$ alkyl, and c) C is a —(CF($CF_3$)$CF_2$O)$_n$—$CF_2$—$CF_2$—$CF_3$, —($CF_2$CF($CF_3$)O)$_n$—$CF_2$—$CF_2$—$CF_3$, —($CF_2CF_2CF_2$O)$_n$—$CF_2$—$CF_2$—$CF_3$, —($CF_2CF_2$O)$_n$$CF_2$—$CF_3$, —CF($CF_3$)—O—(CF($CF_3$)$CF_2$O)$_n$—$CF_2$—$CF_2$—$CF_3$, —CF($CF_3$)—O—($CF_2$CF($CF_3$)O)$_n$—$CF_2$—$CF_2$—$CF_3$, —CF($CF_3$)—O—($CF_2CF_2CF_2$O)$_n$—$CF_2$—$CF_2$—$CF_3$, —$CF_2$—O—($CF_2CF_2$O)$_n$—$CF_2$—$CF_3$ or $C_pF_{2p+1}$ group wherein n and p are integers comprised between 1 and 50, preferably between 1 and 30.

In an even more preferred embodiment, these hydrophobic molecules have the structural formula:

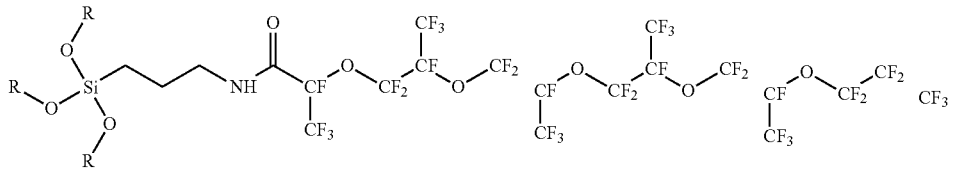

wherein R represents a linear or branched $C_1$-$C_4$ alkyl group.

This molecule, once deposited on surfaces having undergone the protocol of the invention, increases the hydrophobicity thereof in a very advantageous manner (see the contact angle measurements of Example 4). As such, it is also an object of the invention.

It is preferable to deposit these molecules in thin layer (i.e., in a layer the thickness of which is less than 20 nm, preferably less than 10 nm) in order not to alter the roughness of the surface that has been textured by the preceding steps of the process.

The choice of the hydrophobic organic molecules of step c) and of the chemical group that enables them to bind with the material may be a means of ensuring the durability of the effect. The nature of the chemical group bound to the surface makes it possible to respond in a targeted manner to the application for which the surface is made. Thus, it is known that a silane has a durable covalent bond on glass surfaces and that a bisphosphonate binds durably on $TiO_2$ surfaces. Conversely, a fatty acid such as oleic acid will have only weak bonds with these same surfaces, which will be damaged by simple rubbing or by detergent washing, consequently deteriorating the hydrophobic effect without altering the texture of the material.

In a preferred embodiment, if the cross-linking agent is a silicon alkoxide, then silane-based hydrophobic molecules will be preferred.

In another preferred embodiment, if the cross-linking agent is titanium-based, then bisphosphonate-based hydrophobic molecules will be preferred.

In all cases, a radical agent having a hydrophobic functional group may be used.

Uses of the Process of the Invention

The process of the invention is advantageously used for texturing surfaces in order to make them superhydrophilic and/or superoleophilic or to make them superhydrophobic and/or superoleophobic. More generally, it may be used to increase the adhesion of liquid (superliquophilic) in order to improve visibility in the case of condensation or, conversely, to reduce the adhesion of liquids, of solids or of any other contaminant on these surfaces in a lasting manner.

The process of the invention may be applied to all or part of the surface to be treated. If only part of the surface must be made superhydrophobic/philic or superoleophobic/philic, it is possible to use masks to avoid coating certain parts of the surface with nanoparticles and thus to provide regions not functionalized by the superhydrophobic coating at the end of the process. The mask may be removed or degraded at the end of the process by techniques known to a person skilled in the art. Another possibility for saving regions of the surface is to carry out a localized projection of either the nanoparticles or the hydrophobic coating. In an industrial application, this has the advantage of making the surface graspable after deposition of the superhydrophobic treatment.

In another aspect, the present invention also relates to any superhydrophobic/philic and/or superoleophobic/philic surface obtained by the process of the invention. These surfaces are distinguished from those disclosed in the prior art in that they are coated with at least two nanoparticle populations of different sizes, and in that they have not been heated above 80° C., in order to obtain a durable and resistant coating. Such surfaces preferably consist of more than 50%, preferably more than 75%, of a heat-sensitive material, such as polycarbonate (PC), polymethyl methacrylate (PMMA), polypropylene, polyvinyl acetate (PVA), polyamide (PA), polyethylene terephthalate (PET), polyvinyl alcohols (PVAl), polystyrene (PS), polyvinyl chloride (PVC) and polyacrylonitriles (PAN) the glass transition temperatures of which are substantially lower than 200° C.

The surfaces thus treated may be used in various applications, for example in optical or optoelectronic equipment (display systems, lenses, port-holes, eyeglasses, face shields, helmet visors), renewable energies (solar panels), construction materials (windows and doors), the automobile or aerospace industry, windshields, rear-view mirrors or telecommunications (for radar systems, for example).

Surfaces thus treated may be used particularly in liquophobic, anti-corrosion, anti-icing or dirt-resistant applications in industrial fields such as for example cryogenics, aeronautics, wind energy, or even cycles.

Surfaces thus treated may alternatively be used particularly in liquophilic, anti-condensation, anti-fogging or wetting applications.

FIGURE LEGENDS

FIG. 1 presents images obtained by a scanning electron microscope (FEGSEM) of deposits made according to the protocol of Example 1 (dip-coating the glass slide in an aqueous solution of 60 nm diameter silica nanoparticles then grafting of fluorinated silane molecules).

FIG. 2 presents FEGSEM images of deposits prepared with ethanol as solvent in the bath used for deposition by the dip-coating technique (dip-coating the glass slide in a solution of 60 nm diameter silica nanoparticles then grafting of fluorinated silane molecules).

FIG. 3 presents FEGSEM images of deposits prepared by the dip-coating technique from a mixture containing 50% by volume of 0=100 nm silica nanoparticles (0.5% by weight in water) and 50% by volume of 0=15 nm silica nanoparticles (0.5% by weight in water).

FIG. 4 presents FEGSEM images of deposits prepared by the sequential dip-coating technique of 100 nm silica nanoparticles and 15 nm nanoparticles.

FIG. 5 presents FEGSEM images of deposits prepared by the sequential dip-coating technique of 100 nm silica nanoparticles and 15 nm nanoparticles with an intermediate step of APTES functionalization.

FIG. 6 presents FEGSEM images of deposits prepared by the sequential dip-coating technique from solutions of 100 nm silica nanoparticles and 15 nm nanoparticles with an intermediate step of APTES functionalization, for various nanoparticle concentrations: (A) 100 nm: 0.5% by weight in water; 15 nm: 0.5% by weight in water, (B) 100 nm: 0.5% by weight in water; 15 nm: 0.25% by weight in water, (C) 100 nm: 1% by weight in water; 15 nm: 0.25% by weight in water and (D) 100 nm: 1% by weight in water; 15 nm: 0.5% by weight in water.

FIG. 7 presents FEGSEM images of deposits prepared by the sequential dip-coating technique of suspensions of 100 nm and 15 nm silica nanoparticles in ethanol. An intermediate step of APTES functionalization was carried out.

FIG. 8 shows the transmittance as a function of wavelength of the superhydrophobic glass substrates and coatings prepared.

FIG. 9 presents images obtained by a CCD camera, showing (A) on a superhydrophobic and transparent coating without TEOS treatment: scratching by a stylus, (B) on a coating after TEOS treatment: absence of scratching by the stylus.

Figure 16:
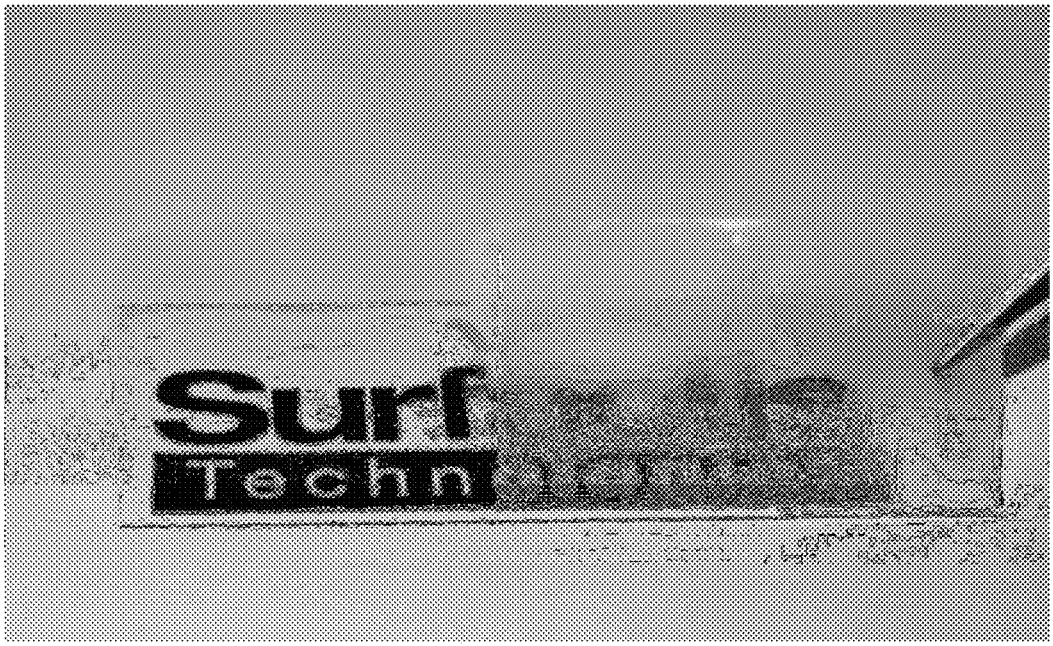

FIG. 16 presents the image of a glass sample having received a superhydrophilic treatment on the left portion and no treatment on the right portion. This glass was cooled to −20° C. then returned to the ambient environment to evaluate the effects of condensation on transparency.

EXAMPLES

1. Protocol for Depositing Particles of One Size

After cleaning a glass surface with detergent, 3-aminopropyl triethoxysilane (APTES) molecules were adsorbed by evaporation for 10 minutes in a vacuum desiccator (pressure=8 mbar). The equilibrium contact angle observed for these surfaces after functionalization and particle deposition is of about 40°.

The particles are then deposited on the surface by the immersion-withdrawal technique (dip-coating) following the order of the following steps:

Preparation of a particle suspension (60 nm diameter, 6 mg/mL) in water,

Dip-coating (DC) the glass slide in the silica nanoparticle suspension (withdrawal speed: 10 mm/min to 100 mm/min), Grafting of fluorinated silane molecules (Diagram 1) for 18 hours in a vacuum desiccator at a pressure of 8 mbar, Annealing for 1 hour at 90° C.

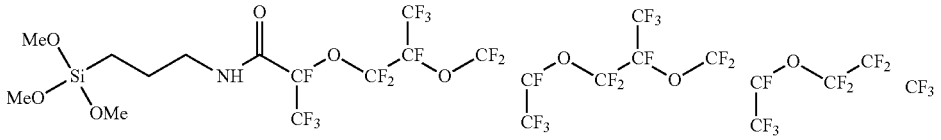

Diagram 1: Representation of the structural formula of the fluorinated silane molecule used in this example.

Figure 1:
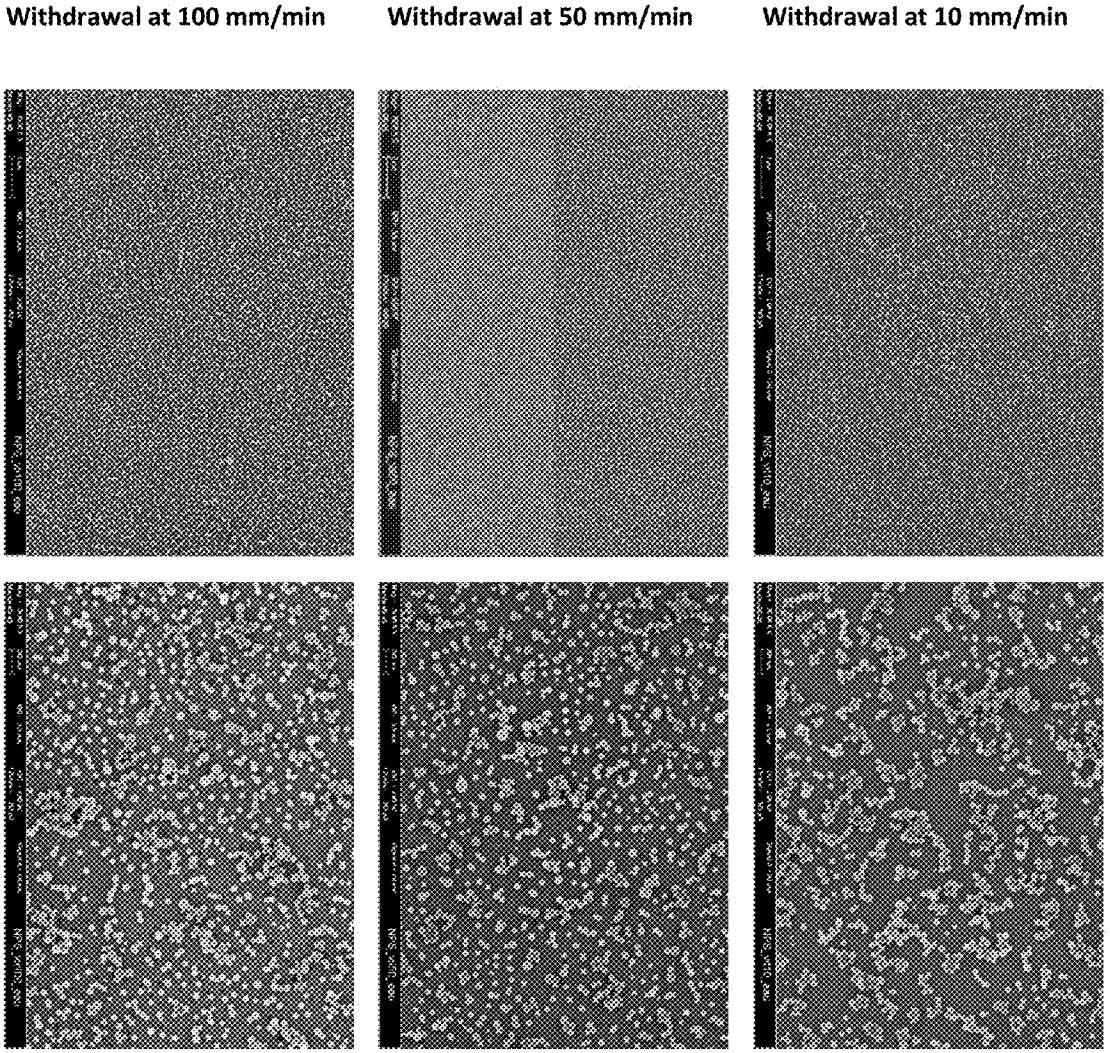

The FEGSEM characterization of the deposits obtained when the silica nanoparticles are suspended in water is presented in FIG. 1.

The results of this characterization show that the silica nanoparticles are distributed randomly on the glass surface with the formation of small agglomerations of particles in areas with no apparent order. It may also be noted that the particle density on the glass surface varies very little with the withdrawal speed.

In order to remedy the nanoparticle agglomeration problem, the particle-solvent interaction was modulated by replacing water with ethanol in the bath used for deposition by the dip-coating technique.

Figure 2:
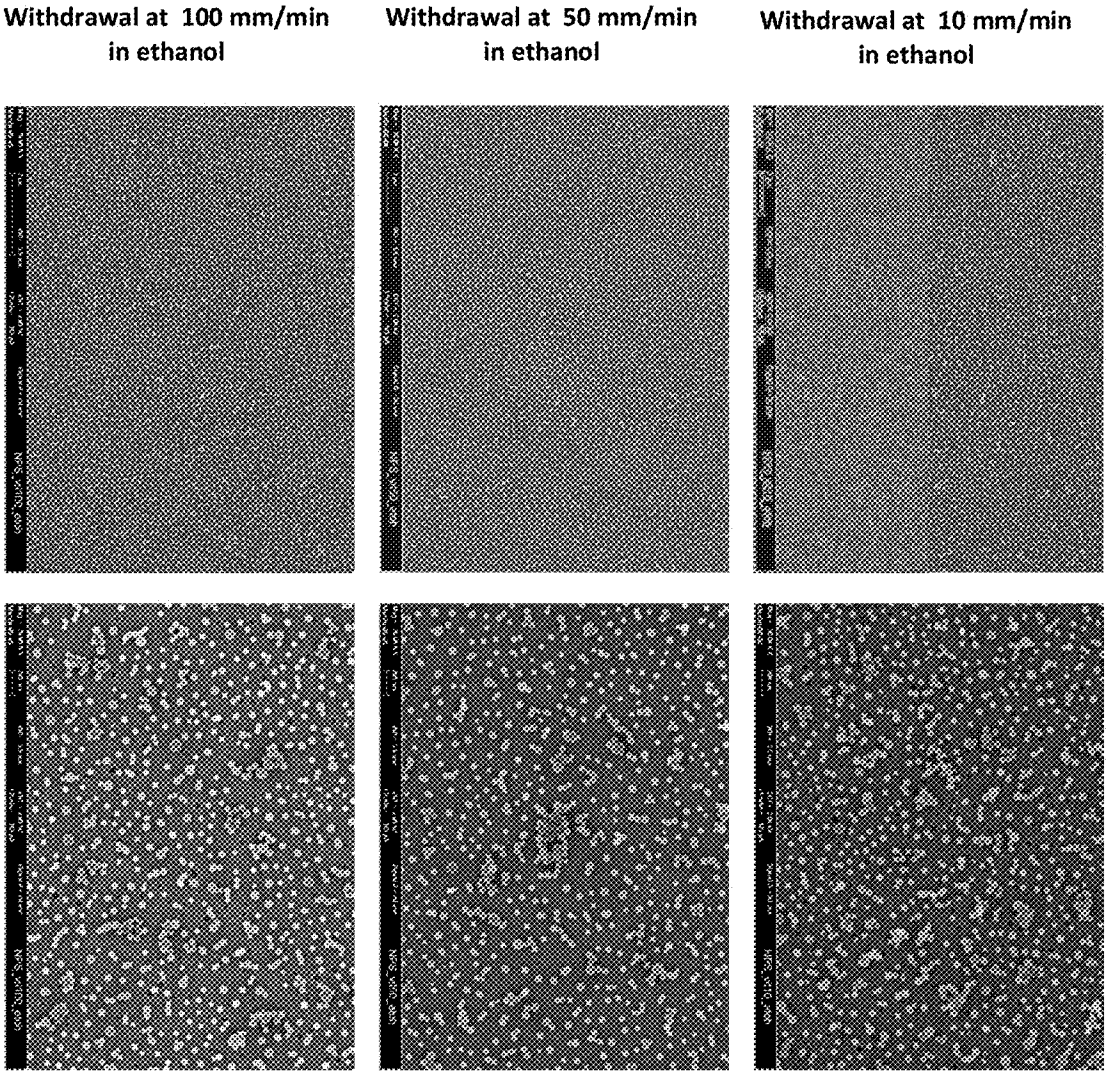

The results of the FEGSEM characterization of these deposits are presented in FIG. 2.

The analysis of the results shows that the use of ethanol as solvent for the nanoparticles makes it possible to obtain on the glass surface particles which are randomly distributed but better dispersed, and with very few aggregates.

After functionalizing these substrates with fluorinated silane molecules for 18 hours, the equilibrium contact angles observed after 1 hour of annealing at 90° C. are 140°.

This shows that by adopting a single nanoparticle size, it is not possible to obtain surfaces the angle of which is greater than 150° under the test conditions.

In this case, no mechanical resistance was obtained (damage to the coating as of the first rubbing due to the absence of cross-linking because the nanoparticles deposited were treated directly after deposition with the hydrophobic agent).

In addition, an identical experiment was carried out with 100 nm particles and the addition of TEOS before evaporation of the silane-PFPE. The results obtained for this surface are presented in the table below.

| Material | CA (°) | Test 9-1 (loss of contact angle in °)* |
|---|---|---|
| Glass | 137 | 40 |

*See experimental conditions of Example 9

The result of this example shows the poor behavior of the coating with a formulation containing only one particle population.

2. Protocol for Depositing Nanoparticles of Two Different Sizes

In this example, the surfaces were washed and treated with APTES according to the protocol presented for substrate preparation when only one size of nanoparticles is deposited (see Example 1).

The deposition by the dip-coating technique was carried out with silica nanoparticle populations of two different average diameters: 100 nm nanoparticles (NP100) having a diameter size distribution comprised between 70 and 100 nm, and 15 nm nanoparticles (NP15) having a diameter size distribution comprised between 10 and 15 nm. The withdrawal speed is 40 mm/min. The grafting of the surfaces with the superhydrophobic molecules was carried out for 18 hours in a vacuum desiccator. Annealing was carried out for 1 hour at 90° C.

2.1. Simultaneous Deposition with an Equal Volume of 100 nm and 15 nm Diameter Silica Nanoparticles After the deposition of an APTES layer (see Example 1), the glass substrates were plunged into a silica nanoparticle solution containing a mixture with an equal volume of 100 nm nanoparticles (0.5% weight concentration) and 15 nm nanoparticles (0.5% weight concentration) in water. The FEGSEM characterization of the deposits obtained is presented in FIG. 3.

Figure 3:
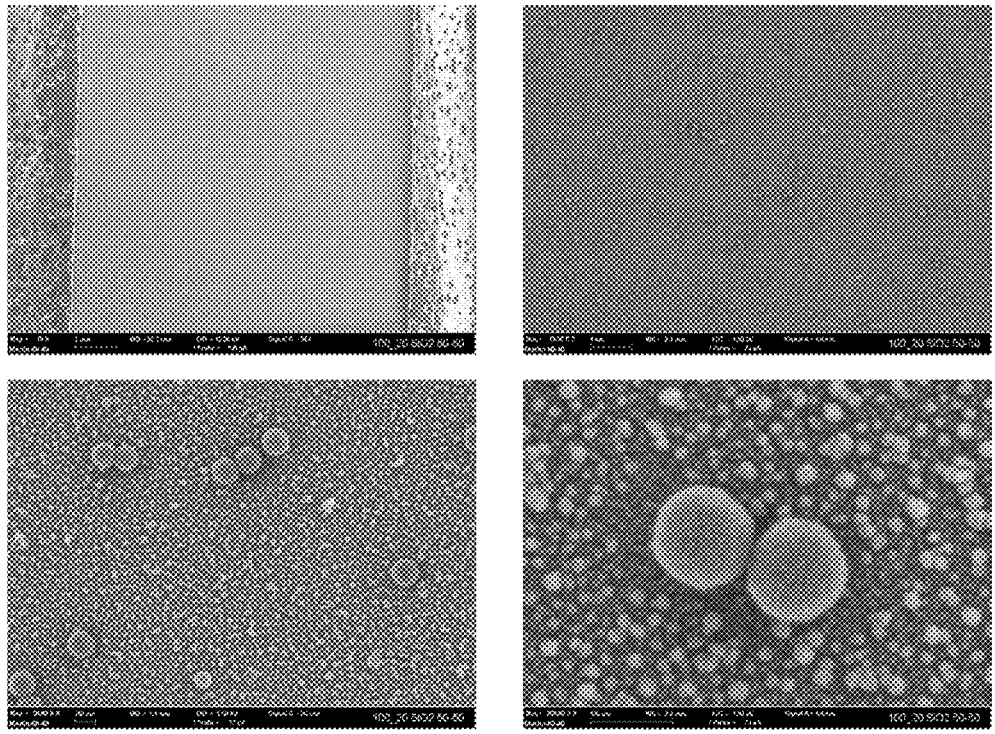

FIG. 3 shows the presence of the two sizes of silica nanoparticles on the glass surface: those of 15 nm are much more numerous than those of 100 nm. These images also show a low degree of surface coating. We note that the preparation of a nanoparticle coating in a single step by dip-coating by mixing the two nanoparticle sizes in equal volume and weight concentration does not lead to superhydrophobic surfaces. The equilibrium contact angle observed after 18 hours of exposure to the fluorinated silane molecule is 128° and the transmittance is 100% relative to the reference glass.

2.2. Sequential Deposition of 100 nm and 15 nm Diameter Silica Nanoparticles

After the deposition of an APTES layer (see Example 1), a first deposition by the dip-coating technique (withdrawal speed=40 mm/min) in a solution containing 100 nm nanoparticles (0.5% weight concentration) in water was carried out. After drying the substrates, a second deposition by the dip-coating technique (withdrawal speed=40 mm/min) was carried out with 15 nm silica nanoparticles (0.5% weight concentration) in water. The FEGSEM characterization of the deposits prepared is presented in FIG. 4.

Figure 4:
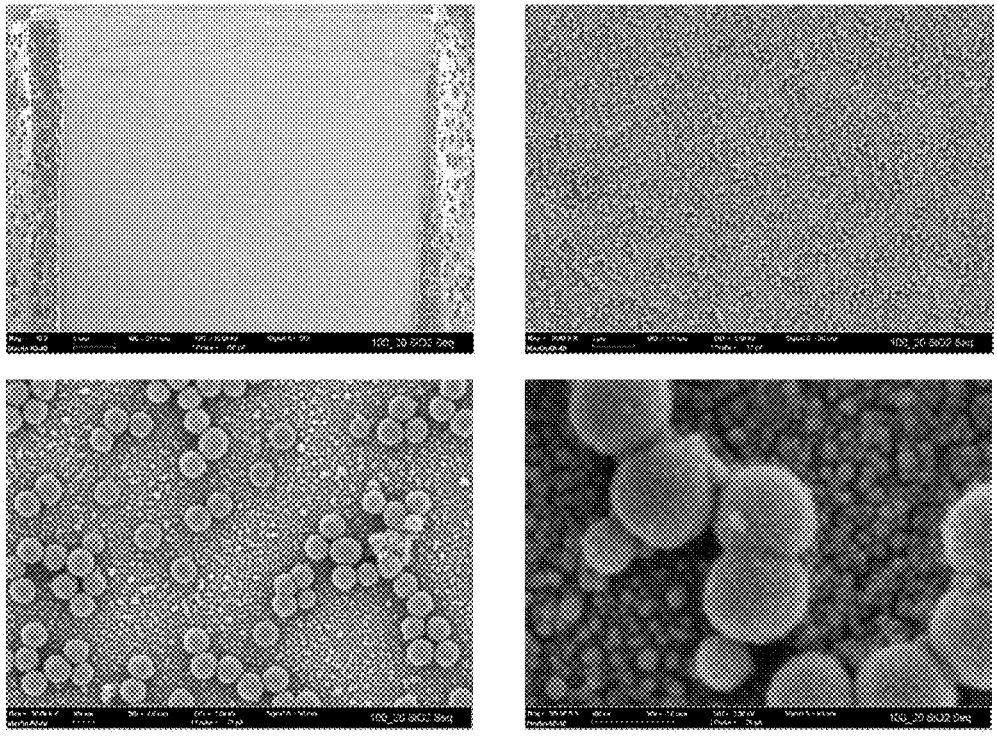

Following the sequential deposition, note may be made of the coexistence of the two sizes of silica nanoparticles on the surface of the glass substrate with more large nanoparticles coating the surface. In parallel, note may be made of the absence of small particles on the surface of the large ones. Furthermore, FIG. 4 shows the existence of a dual scale of roughness. For these structures, the equilibrium contact angle observed after 18 hours of exposure to the fluorinated silane molecule is about 150° and the transmittance is 100%.

2.3. Sequential Deposition of 100 nm and 15 nm Diameter Silica Nanoparticles with an Intermediate Step of Functionalization of the Surface with APTES Molecules.

In the same manner as in the protocol used for the two preceding depositions, the glass substrates were first washed and then functionalized with APTES molecules. A first deposition by the dip-coating technique (withdrawal speed=40 mm/min) was carried out using a solution containing 100 nm nanoparticles (0.5% weight concentration) in water.

After drying the substrate, an additional step of functionalization of the substrates was carried out with APTES molecules under vacuum in a desiccator for 10 minutes.

After this step, a second deposition cycle was carried out by the dip-coating technique (withdrawal speed=40 mm/min) using an aqueous solution of 15 nm silica nanoparticles (0.5% weight concentration).

Figure 5:
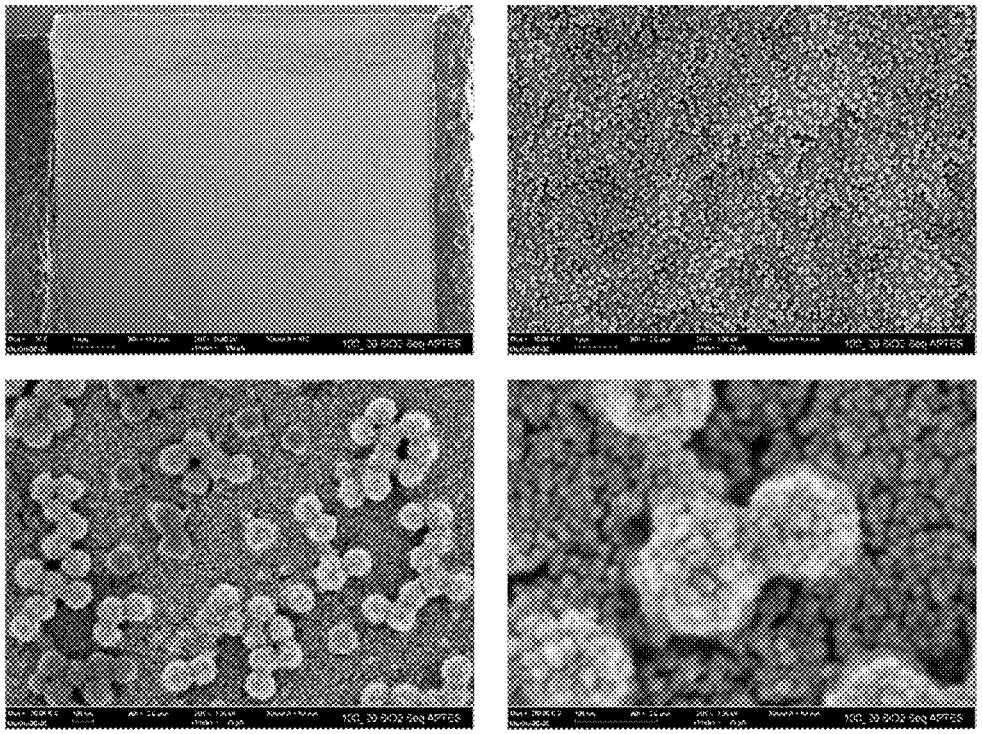

The FEGSEM characterization of the deposits obtained is presented in FIG. 5.

The FEGSEM images of FIG. 5 show that a better roughness is obtained for this third process. Indeed, by introducing an intermediate step of APTES functionalization, the adhesion between the large and the small particles was increased. This made it possible to obtain raspberry-shaped particles with the small particles coating the surface of the large particles. The equilibrium contact angle observed for these deposits after 18 hours of exposure to the fluorinated silane molecule is greater than 150° and the transmittance is 100% (in the visible wavelength range).

3. Protocol for Depositing Nanoparticles of Two Different Sizes—Effect of Particle Concentration While retaining the experimental protocol of Example 2.3, we varied the concentration of the 15 nm silica nanoparticles while keeping the weight concentration of the 100 nm nanoparticles equal to 0.5%.

To ensure better adhesion between nanoparticles and between the nanoparticles and the substrate, and thus to improve the mechanical properties of the deposits, a sol-gel deposition of silica was carried out before the deposition of the hydrophobic layer. This deposition also was carried out by the dip-coating technique (withdrawal speed=40 mm/min, soaking=2 hours).

Figure 6:
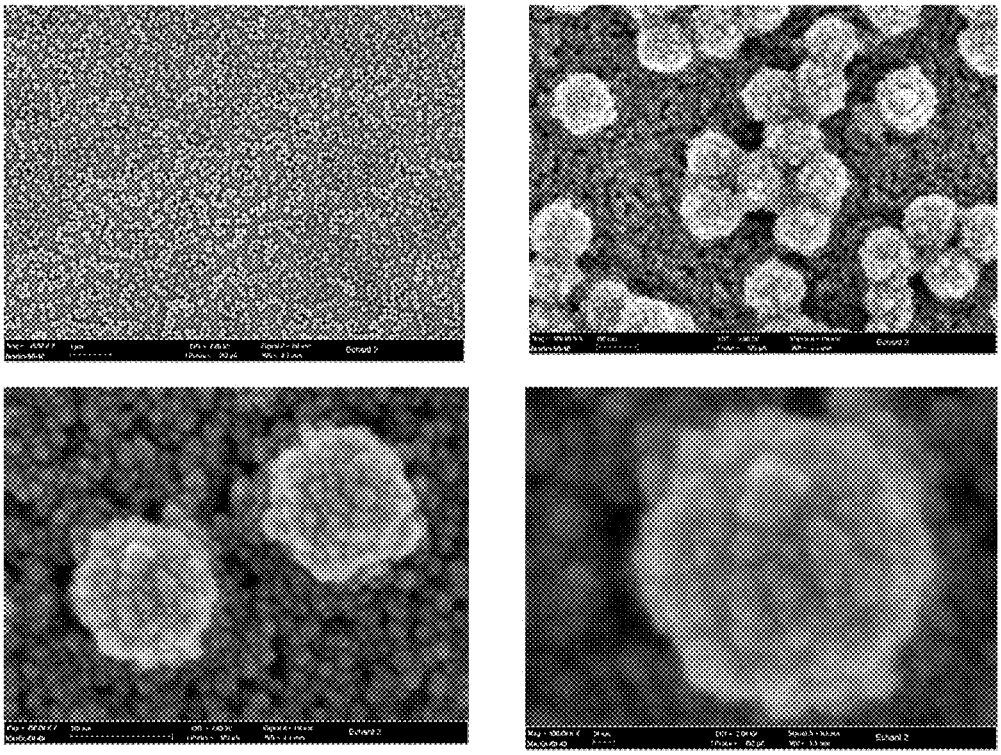
Figure 6:
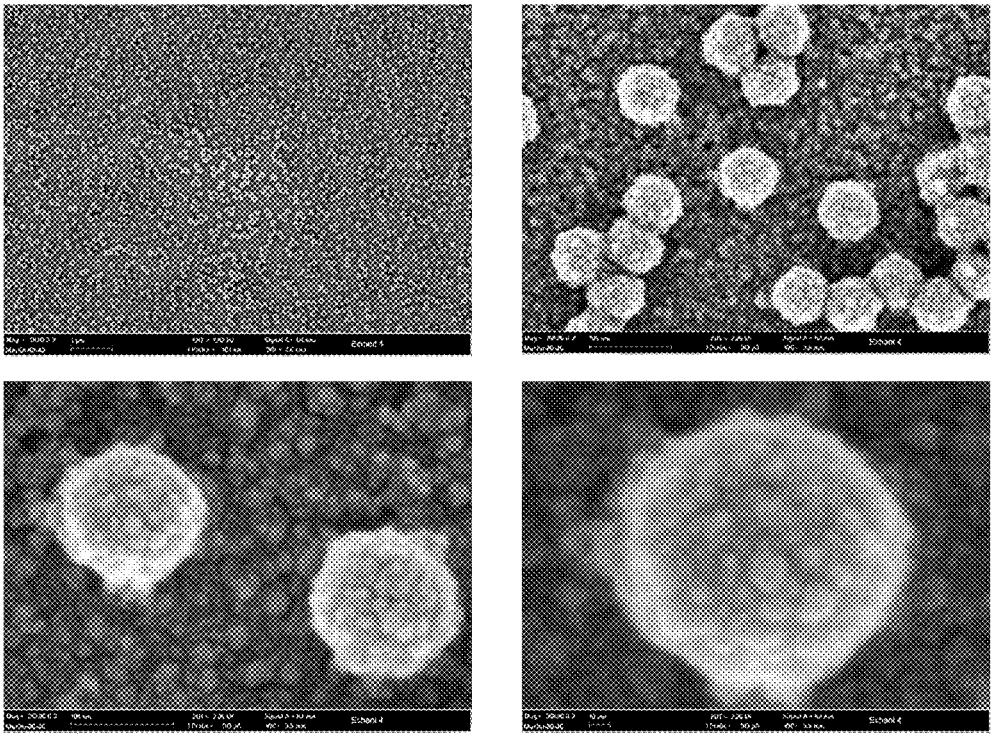
Figure 6:
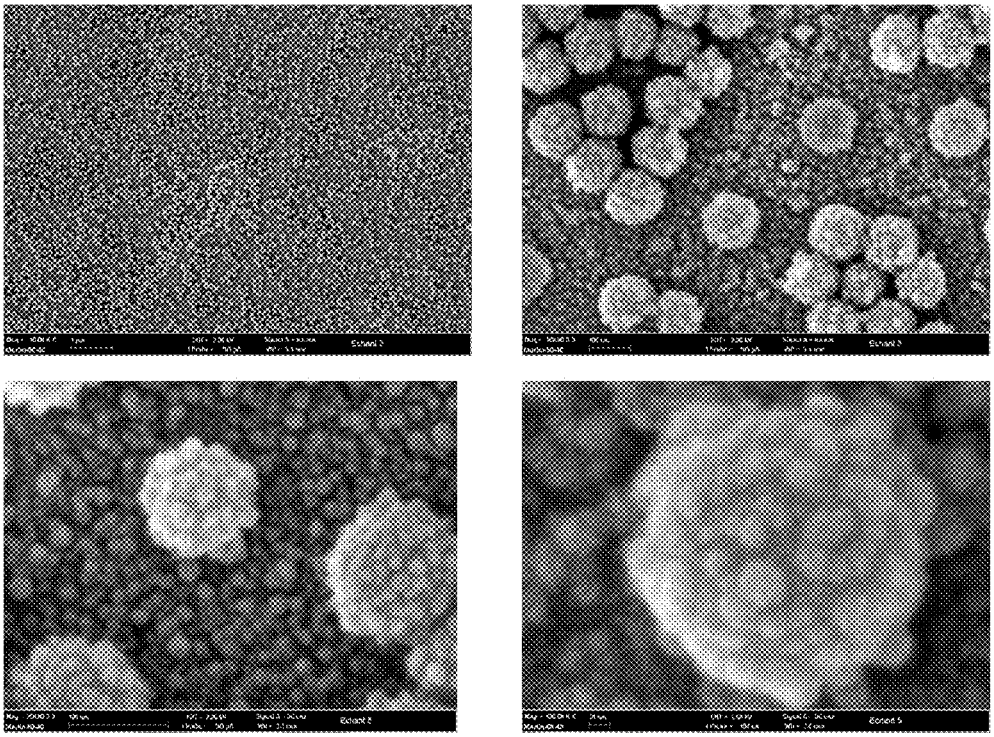
Figure 6:
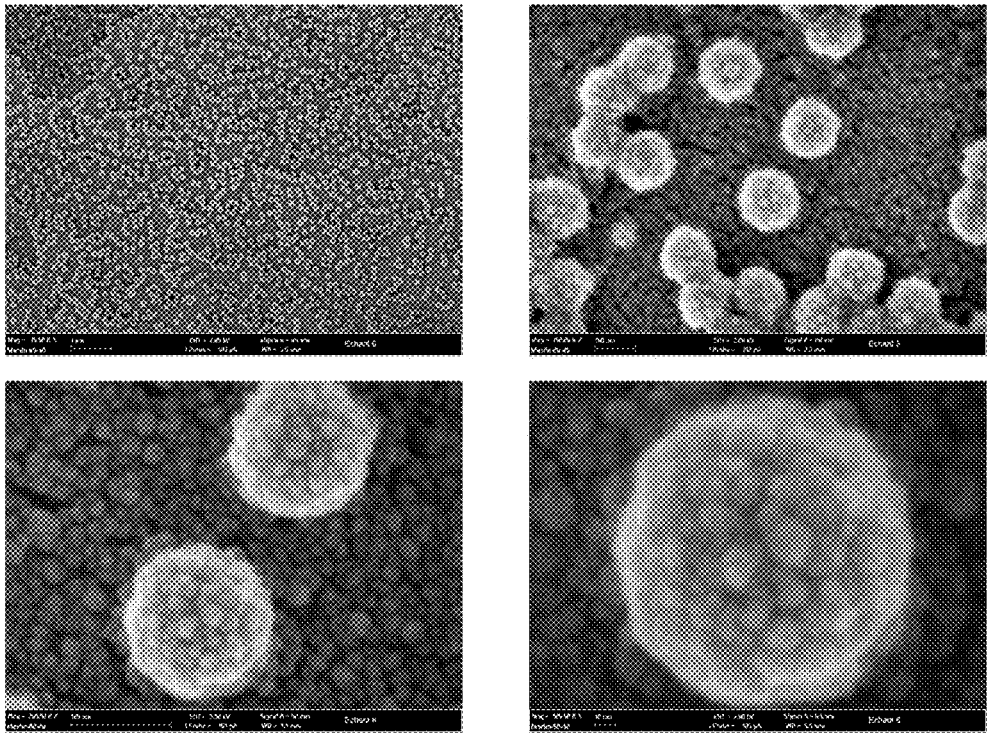

The FEGSEM images of the deposits prepared are presented in FIG. 6.

FIG. 6 shows that when the concentration of one nanoparticle size increases, the coating of the surface increases. Two situations may be distinguished:

a) when the concentration of the 100 nm nanoparticles increases, the coating of the substrate increases.
b) when the concentration of 15 nm nanoparticles increases, the coating of the larger nanoparticles increases.

From these experiments, it emerges that the best surface roughness is obtained with a weight concentration of 0.5% and 0.25% for the suspensions of 100 nm and 15 nm nanoparticles, respectively.

4. Protocol for Depositing Nanoparticles of Two Different Sizes—Effect of Solvent and Cross-Linking Agent The nanoparticles agglomerate when water is used as solvent. While retaining the experimental protocol of Example 2.3, we varied the nature of the solvent (water and ethanol). We also optionally added a TEOS cross-linking phase before the deposition of the hydrophobic final layer.

The TEOS deposition is carried out by dip-coating (speed=20 mm/min), with a soaking time of 2 hours. The solution used is a mixture of TEOS (1 volume) and ammonia (8 volumes) in ethanol.

Figure 7:
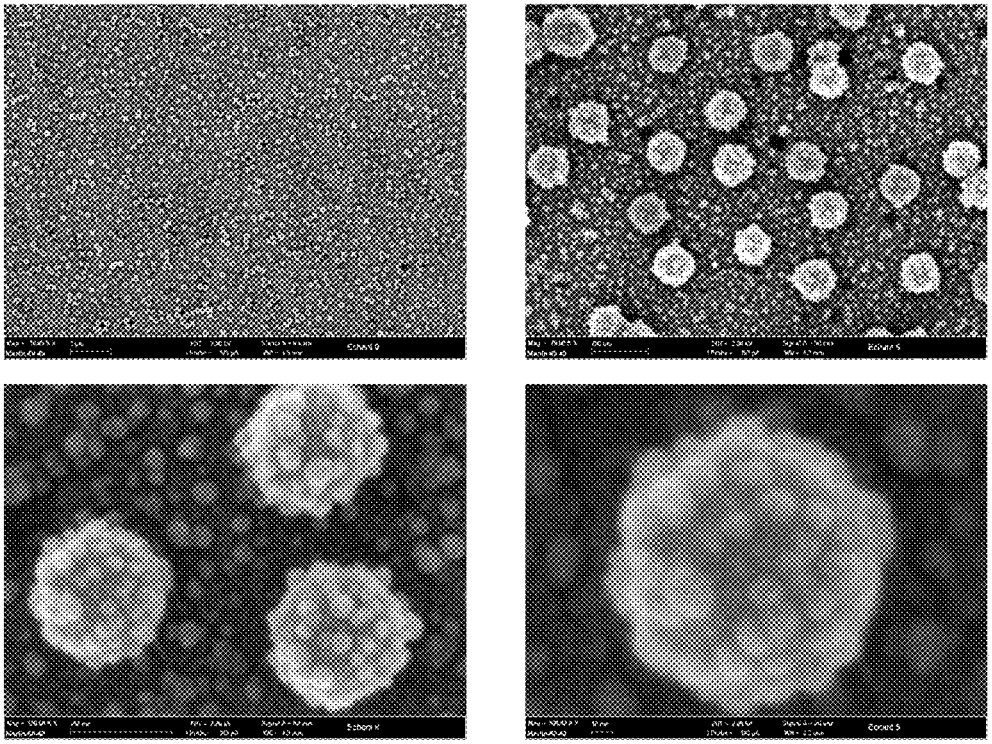

FIG. 7 shows the FEGSEM images of the deposits produced.

These results, compared with those of Example 2.3, show that the particles have a less aggregated appearance, once deposited on the surface, when the deposition is carried out in ethanol as solvent.

The contact angle measurement was carried out at each step of the process mentioned in this example. An untreated glass surface gives water contact angles of about 20°. The maximum contact angle that may be reached by the functionalization of planar glass surfaces with the fluorinated silane molecule of Diagram 1 is of about 110°. After the step of texturing the glass surface with the various nanoparticle deposits, without TEOS deposition, and after deposition of the same fluorinated molecules, this angle is of about 150°. After the deposition of TEOS and the fluorinated molecules, the equilibrium contact angle reaches 155° and the coating is superhydrophobic.

It arises from the results obtained in this example that the surface roughness is improved when the deposition is carried out with a 0.5% weight concentration of 100 nm nanoparticles and 0.25% of 15 nm nanoparticles in ethanol as solvent. Furthermore, the contact angles are slightly greater when the deposition of the cross-linking agent (TEOS) is carried out.

5. Transparency

Figure 8:
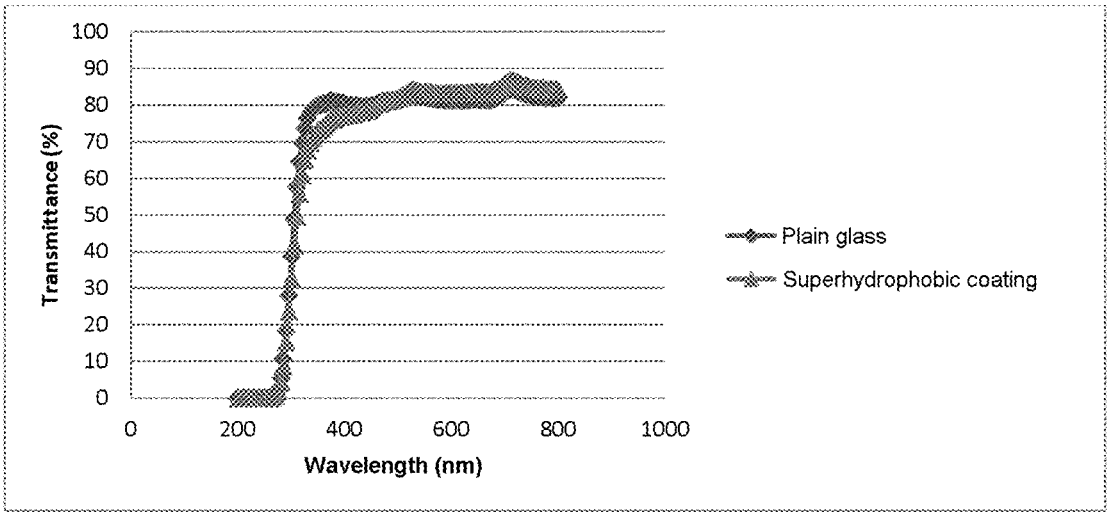

Transparency is expressed as a high transmittance near 100%. For the coating of Example 2.3, a transmission spectrum in the visible wavelength range was carried out. A transmittance of 100% was measured relative to the reference glass (FIG. 8). This result is expected, since the roughness of the coatings is less than 100 nm.

6. Methods for Cross-Linking TEOS:

6.1 Comparison Between Surfaces Cross-Linked with TEOS in Acidic Medium and Basic Medium-Adhesive Tape Behavior Test.

The coating tested is similar to that is described in Example 2.3 It is set with either:

- a deposition of TEOS in basic solution by dip-coating (speed=40 mm/min), with a soaking time of 2 hours. The solution used in this case is a mixture of TEOS and ammonia in water,
- a deposition of TEOS in acidic solution by dip-coating (speed=20 mm/min), with a soaking time of 2 hours. The solution used in this case is a mixture of TEOS and HCl in a water/ethanol mixture at pH 2.

In basic conditions, the results show that, with or without thermal annealing, the superhydrophobic coating obtained does not resist the adhesive tape test. At the end of the test, no particles are visible on the surface.

In contrast, after treatment in acidic medium, the surface shows no degradation related to the adhesive force of the tape and, after the test, the nanoparticle film remains fully applied to the surface.

6.2 Optimization of the TEOS Concentration Used in Acidic Medium

Brief protocol:

1) Pre-washing
2) 5 DC of NP100
3) 3 DC of TEOS
4) 1 DC of NP15
5) 1 DC of TEOS
6) Silane

| TEOS concentration (mM) | CA (°) | Test 9-3 (loss of contact angle in °)* |
|---|---|---|
| 8 | 149 | −28 |
| 10 | 145 | −10 |
| 12 | 147 | −13 |
| 24 | 146 | −10 |
| 80 | 128 | −9 |

*See experimental conditions of Example 9

Conclusion:

In these given experimental conditions, the optimal TEOS concentration value is between 10 and 24 mM.

7. Scratch Resistance

In order to characterize the mechanical properties of the coatings produced and, more precisely, the scratch resistance thereof, we used an optical profilometer provided with a diamond stylus (12.5 μm radius). With this stylus, we applied to the substrate a maximum load of 15 mg. This load corresponds to a force of 147.1 μN, or a pressure of 3061 g/cm$^2$.

In this case, the samples were prepared according to the protocol of Example 6. TEOS was deposited in acidic conditions.

Figure 9:
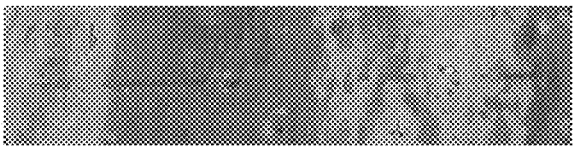
Figure 9:
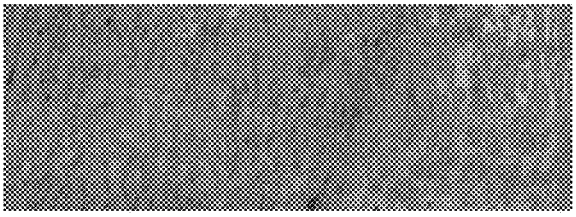

Without the TEOS deposition, the coatings produced scratched easily. But with this deposition, and thanks to the Si—O—Si bonds, these coatings remain intact after having applied a maximum pressure with the diamond stylus (FIG. 9).

8. Behavior of the Coating in the Adhesive Tape Test

In this test, double-sided adhesive tape was affixed on the coating and then pulled off in a single motion. This "adhesive tape" test is used to test the adhesion of nanoparticle films on the glass surface. In this example, none of the surfaces were treated with a hydrophobic compound to minimize the anti-adhesive effect of the superhydrophobic coating and to model the adhesion of the particles to the material.

Figure 10:
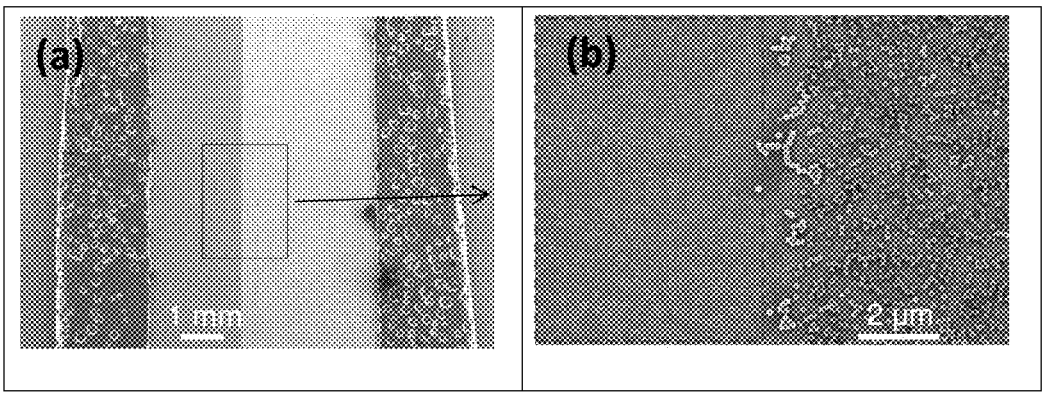
FIG. 10 shows the FEGSEM characterization of a nanoparticle coating not set by the cross-linking agent (TEOS) having undergone an adhesive tape test: the region delimited by a square indicates the region where the adhesive tape was pulled off.

Once the "adhesive tape" test is carried out, the surfaces are observed by FEGSEM and a comparison is made between the regions from which the tape was pulled off and the untested regions. The surfaces evaluated are the following:

a) Deposition according to Example 2.3 without addition of a cross-linking agent
b) Deposition according to Example 2.3 with addition of a cross-linking agent (TEOS in acidic medium)
c) Deposition according to Example 2.3 with addition of a cross-linking agent (TEOS in acidic medium) and annealing at 80° C. for 6 hours.

a) Deposition According to Example 2.3 without Addition of a Cross-Linking Agent In the case of a coating prepared according to the protocol of Example 2.3 and not having undergone the TEOS consolidation step, the nanoparticle film sticks easily to the adhesive tape (FIG. 10). The magnified region of FIG. 10*b* shows a region free of particles (in the square), whereas the unevaluated region has an arrangement of particles identical to the preceding examples.

b) Deposition According to Example 2.3 with Addition of a Cross-Linking Agent (TEOS in Acidic Medium)

In another test, the protocol of Example 2.3 was implemented and the surfaces were then cross-linked by adding TEOS. The results of the adhesive tape test on this sample (FIGS. 11*a* and 11*b*) show a very good resistance of the nanoparticle film to the force of the adhesive tape because the nanoparticle film remains applied to the surface after the test.

c) Deposition According to Example 2.3 with Addition of a Cross-Linking Agent (TEOS in Acidic Medium) and Annealing at 80° C. for 6 Hours.

Figure 11:
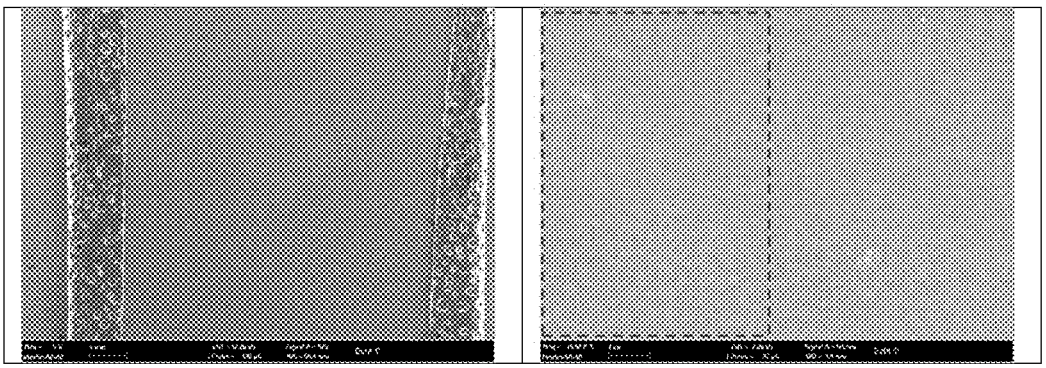
FIG. 11 shows the FEGSEM characterization of a nanoparticle coating after the TEOS consolidation step after the adhesive tape test: the region delimited by a square indicates the region where the adhesive tape was pulled off.
Figure 12:
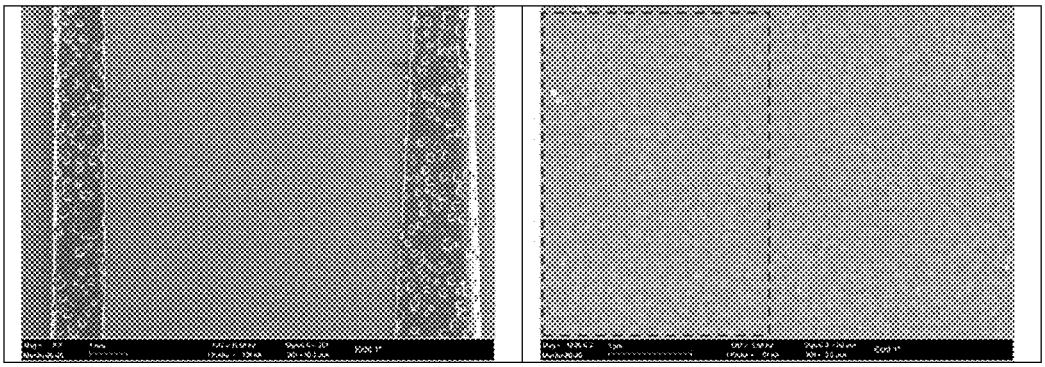
FIG. 12 shows the FEGSEM characterization of a nanoparticle coating after the TEOS consolidation and thermal annealing steps, after the adhesive tape test: the region delimited by a square indicates the region where the adhesive tape was pulled off.

In a third test, an additional annealing of 6 hours at 80° C. was applied to a surface having undergone the same coating as in FIG. 11. The results presented in FIG. 12 show that the annealing step provides no major improvement to the resistance of the nanoparticle films with respect to FIG. 11.

9. Behavior of the Coating in the Rubbing Test Using a Cotton Swab Soaked with Isopropanol This rubbing test makes it possible to evaluate the mechanical resistance of the surfaces having received a superhydrophobic coating. It consists in applying several types of rubbing to the surface and evaluating the changes in the contact angle on these surfaces after the rubbing phase. The tests carried out are:

Test 9-1: Application of 100 dry rubs with a soft cloth attached to a 500 g mass distributed over 1 $cm^2$ Test 9-2: Application of 100 dry rubs with a soft cloth attached to a 1000 g mass distributed over 1 $cm^2$ Test 9-3: Application of 100 rubs with isopropanol-soaked cotton attached to a 100 g mass distributed over 1 $cm^2$ Test 9-4: Application of 100 rubs with isopropanol-soaked cotton attached to a 500 g mass distributed over 1 $cm^2$ Test 9-3 was applied to the surfaces of Example 8, namely:

a) Deposition according to Example 2.3 without addition of a cross-linking agent, b) Deposition according to Example 2.3 with addition of a cross-linking agent (TEOS in acidic medium), c) Deposition according to Example 2.3 with addition of a cross-linking agent (TEOS in acidic medium) and annealing at 80° C. for 6 hours.

Figure 13:
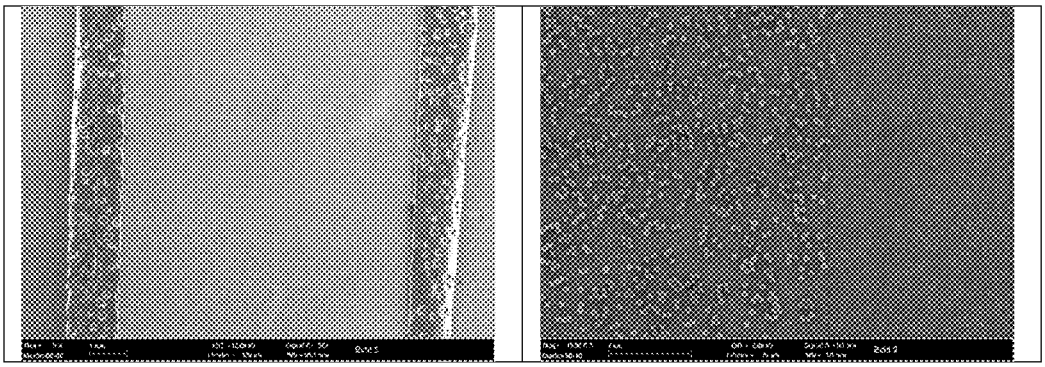
FIG. 13 shows the FEGSEM characterization of the cotton-swab rubbing test carried out on a nanoparticle coating not having undergone the TEOS consolidation step: the region delimited by a square indicates the region evaluated.

Once the rubbing is carried out, the surfaces are observed by FEGSEM and a comparison is made between the regions having undergone rubbing and the unrubbed regions.

a) Deposition According to Example 2.3 without Addition of a Cross-Linking Agent When a coating is made only of silica nanoparticles without TEOS consolidation, the nanoparticles come off easily when rubbed with a cotton swab (FIG. 13).

b) Deposition According to Example 2.3 with Addition of a Cross-Linking Agent (TEOS in Acidic Medium)

In another test, the protocol of Example 2.3 was implemented and the surfaces were then cross-linked by adding TEOS. The FEGSEM characterization of the coatings prepared is presented in FIG. 14. It may be noted that the TEOS consolidation step provides a clear improvement of the nanoparticle films to resistance to the rubbing test using an isopropanol-soaked cotton swab.

c) Deposition According to Example 2.3 with Addition of a Cross-Linking Agent (TEOS in Acidic Medium) and Annealing at 80° C. for 6 Hours.

Figure 14:
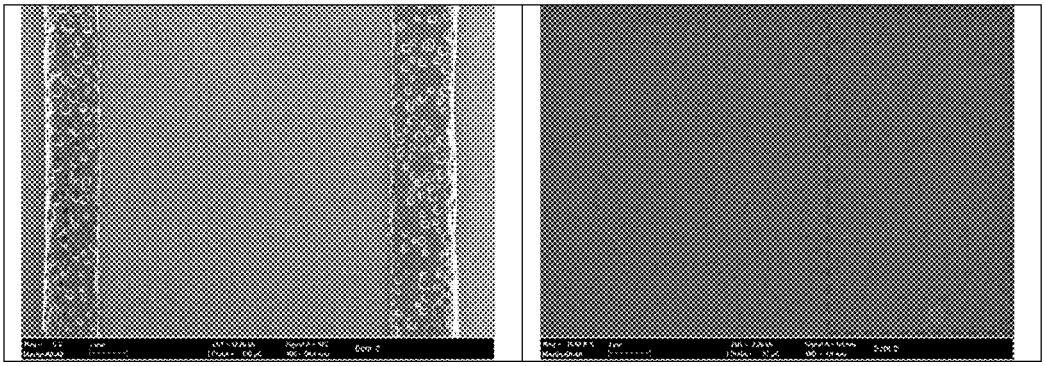
FIG. 14 shows the FEGSEM characterization of the cotton-swab rubbing test carried out on a nanoparticle coating having undergone a TEOS consolidation step: the region delimited by a square indicates the region evaluated.
Figure 15:
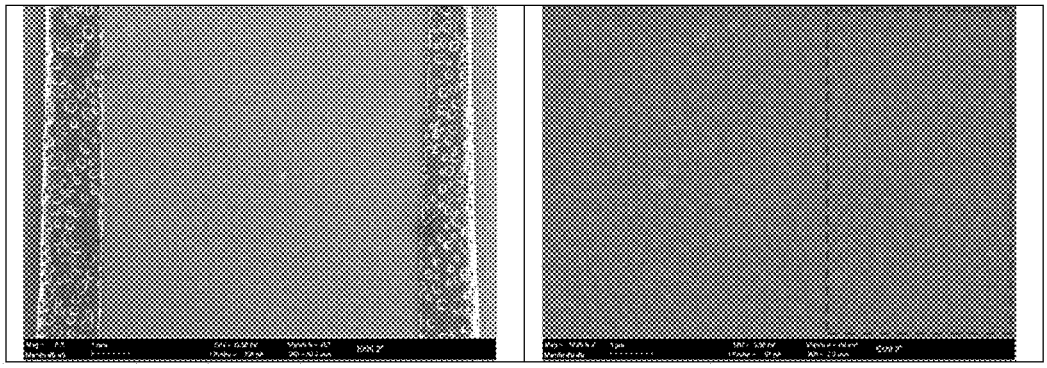
FIG. 15 shows the FEGSEM characterization of the cotton-swab rubbing test carried out on a nanoparticle coating having undergone the TEOS consolidation and thermal annealing steps: the region delimited by a square indicates the region evaluated.

In a third test, an additional annealing of 6 hours at 80° C. was applied to a surface having undergone the same coating as in FIG. 14. The results presented in FIG. 15 show that the annealing step provides no major improvement to the resistance of the nanoparticle films with respect to FIG. 14.

Consequently, this annealing step may be eliminated from our process for preparing nanoparticle films.

10. Protocol for Depositing Nanoparticles of Two Different Sizes with no Amino Silane-Type Adhesion Primer a. After cleaning a glass surface with a detergent, a first deposition by the dip-coating technique (withdrawal speed=100 mm/min) is carried out using a solution containing 100 nm nanoparticles (0.5% weight concentration) in alcohol. This step is repeated 5 times. The pieces are dried at 80° C. for 1 hour.

b. A deposition of TEOS in acidic solution by dip-coating (speed=100 mm/min), with a soaking time of 2 hours, is carried out. The solution used is a mixture of TEOS and HCl (1 equivalent/5 equivalents) in a water/alcohol mixture at pH 2. The TEOS concentration in this bath is 10 mM. The pieces are dried at 80° C. for 1 hour.

c. A second deposition cycle is carried out by the dip-coating technique (withdrawal speed=100 mm/min) using a solution in alcohol of 15 nm silica nanoparticles (0.5% weight concentration). The pieces are dried at 80° C. for 1 hour.

d. A deposition of TEOS in acidic solution by dip-coating (speed=100 mm/min), with a soaking time of 2 hours, is carried out. The solution used is a mixture of TEOS and HCl (1 equivalent/5 equivalents) in a water/alcohol mixture at pH 2. The TEOS concentration in this bath is 10 mM. The pieces are dried at 80° C. for 1 hour.

e. Grafting of fluorinated silane molecules for 18 hours in a vacuum desiccator, annealing for 1 hour at 80° C.

| Material | CA (°) | Sliding angle (°) | Test 9-1 (loss in °) | Test 9-2 (loss in °) | Test 9-3 (loss in °) | Test 9-4 (loss in °) |
|---|---|---|---|---|---|---|
| Glass 1 | 147 | — | 8 | 9 | 12 | 11 |
| Glass 2 | 150 | 7 | — | — | 14 | — |

These results show that the superhydrophobic effect is achieved by this protocol and that the mechanical and chemical resistance is high.

11. Preparation of Raspberry Particles

For the needs for our tests, several families of "raspberry" particles were synthesized based on large silica particles onto which a chemical group was grafted. These particles are then contacted with smaller silica particles. The reactive groups presented are amines (Langmuir 2011, 27, 4594), epoxides (Nano Lett. 2005, 5, 2298) and isocyanates.

1) RNP (Amine)

Into an anhydrous 100 mL round-bottom flask equipped with a condenser are introduced under argon NP100 (1 g) and 50 mL of ethanol (EtOH). The mixture is plunged into an ultrasonic bath for 30 minutes. APTMS (450 μL) is then introduced with a syringe and the reaction medium is heated at reflux overnight. The reaction medium is cooled to room temperature (RT). After concentration under vacuum, the particles are suspended in 50 mL of toluene. The mixture is centrifuged at 3000 rpm for 10 minutes. The supernatant is discarded. This operation is repeated three times. The particles are then dried under vacuum at 50° C. for several hours. These particles are called NP100-NH2 particles.

Into an anhydrous 100 mL round-bottom flask equipped with a condenser are introduced under argon NP100-NH2 (500 mg), NP15 (315 mg) and 40 mL of EtOH. The mixture is plunged into an ultrasonic bath for 30 minutes, then the reaction medium is stirred overnight at 50° C. The mixture is cooled to RT. Ethanol is introduced in order to prepare a 0.5% weight solution.

2) RNP (Epoxide)

Into an anhydrous 100 mL round-bottom flask equipped with a condenser are introduced under argon NP100 (1 g) and 50 mL of toluene. The mixture is plunged into an ultrasonic bath for 30 minutes. Silane epoxide (530 μL) is then introduced with a syringe and the reaction medium is heated at 50° C. overnight. The reaction medium is cooled to RT. The mixture is centrifuged at 3000 rpm for 10 minutes. The supernatant is discarded. This operation is repeated three times. The particles are then dried under vacuum at 50° C. for several hours. These particles are called NP100-epoxide particles.

Into an anhydrous 100 mL round-bottom flask equipped with a condenser are introduced under argon NP100-epoxide (970 mg), NP15 (620 mg) and 20 mL of dimethylformamide (DMF). The mixture is plunged into an ultrasonic bath for 30 minutes, then the reaction medium is heated at reflux overnight. The mixture is cooled to RT. The mixture is centrifuged at 3000 rpm for 10 minutes. The supernatant is discarded. The particles are then dried under vacuum at 50° C. for several hours.

3) RNP (Isocyanate)

Into an anhydrous 100 mL round-bottom flask equipped with a condenser are introduced under argon NP100 (1 g) and 30 mL of toluene. The mixture is plunged into an ultrasonic bath for 30 minutes. Silane isocyanate (490 mg) is then introduced with a syringe and the reaction medium is stirred overnight at RT. The mixture is centrifuged at 3000 rpm for 10 minutes. The supernatant is discarded. This operation is repeated three times. The particles are then dried under vacuum at 50° C. for several hours. These particles are called NP100-NCO particles.

Into an anhydrous 100 mL round-bottom flask equipped with a condenser are introduced under argon NP100-NCO (760 mg), NP15 (480 mg) and 15 mL of toluene. The mixture is plunged into an ultrasonic bath for 30 minutes, then the reaction medium is stirred overnight at reflux. The mixture is cooled to RT. The solvent is evaporated and the particles are then dried under vacuum at 50° C. for several hours.

12: Deposition of the Raspberry Particles on Glass Slides

Several different protocols were employed to deposit the particles on glass surfaces. Several variations were introduced into the protocol of Example 9 to prepare these surfaces. They particularly relate to the number of soakings in TEOS (3 soakings) and to the deposition of 15 nm nanoparticles followed by the deposition of TEOS (not carried out in Protocol 1, carried out in Protocol 2) carried out after deposition of the RNP.

The RNP used in this example are those prepared in Example 11.

Briefly, the experimental conditions are summarized below:

| Protocol 1: | Protocol 2: |
|---|---|
| Pre-washing | Pre-washing |
| 5 DC of RNP | 5 DC of RNP |
| 3 DC of TEOS (10 mM) | 3 DC of TEOS (10 mM) |
| Silane | 1 DC of NP15 |
| | 1 DC of TEOS |
| | Silane |

The pieces are dried at 80° C. for 1 hour after each dip-coating step and for 2 hours after deposition of the silane.

| RNP | Protocol | CA (°) | Test 9-3 (loss in °) |
|---|---|---|---|
| Amino | 1 | 145 | Unstable |
| | 2 | 143 | Unstable |
| Epoxide | 1 | 143 | 26 |
| | 2 | 143 | 23 |
| Isocyanate | 1 | 134 | 16 |
| | 2 | 134 | 17 |

The surfaces coated with raspberry particles all have contact angles of about 134° to 145°. After abrasion, only the "amino" particles are unstable. They are degraded as of the first abrasion cycle. All the other particles exhibit intermediate behaviors. This shows that the electrostatic bonds created between the different particle populations by the amine groups are not sufficient to ensure that the material formed is resistant.

13: Activation of Polymer Materials by UV-Ozone

Polymeric pieces like PMMA are poorly wettable when they do not undergo activation treatment. This does not allow nanoparticle or TEOS solutions to spread satisfactorily and thus to coat the surfaces uniformly. Some of the surfaces were thus made wettable by UV-ozone activation. The apparatus used for UV/ozone activation is the Pro-Cleaner™ Plus from BioForce Nanosciences. The rated output is 14.76 mW/cm$^2$ at 1 cm from the source. The light intensity is distributed at 2% at 185 nm and at 45% at 254 nm. Before use, the apparatus preheated for 10 minutes. The PMMA sample, first washed with an aqueous detergent and dried, is exposed at 2.5 cm from the UV source for 10 minutes.

The contact angle of a 1 μL water drop on the PMMA passes from about 80° before activation to 20° after activation.

14: Activation of Polymer Materials by Atmospheric Plasma

Polymeric pieces like PMMA are poorly wettable when they do not undergo activation treatment. This does not allow nanoparticle or TEOS solutions to spread satisfactorily and thus to coat the surfaces uniformly. Some of the surfaces were thus made wettable by atmospheric plasma activation. The apparatus used for plasma activation is the ULS spot (Acxys Technologies). Plasma is supplied by compressed air at a pressure of 4 bar. The plasma is activated at a power of 800 W. The substrates (PMMA or PC) to be treated are swept at a speed of 200 mm/s with a 4 mm step. Two applications were dispensed. The contact angle of a 1 μL water drop passes from about 80° to 20°.

15: Particle Deposition by Spray 15-1 On Glass

The surface preparation conditions are similar to Example 10. The same solutions were prepared and used. The nanoparticle solutions (NP100 and NP15) were then sprayed using a 50 mL atomizer placed 15 cm from the surface in a vertical position.

The protocol used is the following:

Pre-washing
5 sprays of NP100
1 spray of TEOS (10 mM)
1 spray of NP15
1 spray of TEOS
Silane An annealing at 80° C. is carried out for 1 hour after each spray step and for 2 hours after deposition of the hydrophobic agent.

The results obtained are presented in the table below:

| Material | CA (°) | Sliding angle (°) | Test 9-3 (loss in °) |
|---|---|---|---|
| Glass | 151 | 16 | 16 |

This result shows that it is possible to obtain a textured surface on glass using this process by carrying out the successive deposition of different particle populations. This result also shows that this superhydrophobic treatment has good mechanical resistance properties.

15-2 On PMMA

The surface preparation conditions are similar to Example 10. The same solutions were prepared and used.

PMMA is first activated by UV-ozone and coated with a TEOS primer layer as defined in Example 20.

The nanoparticle solutions (NP100 and NP15) were then sprayed using a 50 mL atomizer placed 15 cm from the surface in a vertical position.

The protocol used is the following:

Pre-washing

UV-ozone activation

1 DC of TEOS 5 sprays of NP100

1 spray of TEOS 1 spray of NP15

1 spray of TEOS

Silane

The pieces are dried at 80° C. for 2 hours after the dip-coating of TEOS, for 1 hour after each spray step and for 2 hours after deposition of the silane.

| Material | CA (°) | Test 9-3 (loss in °) |
|---|---|---|
| PMMA | 146° | 20° |

16: Simultaneous Deposition of a Mixture of Different Sizes of Particles and of TEOS by Dip-Coating Example 10 describes a sequential deposition of NP100, TEOS, then NP15 and TEOS. In this example, the process was shortened by mixing the particles with the TEOS solution.

Several variants were carried out. The variants relate to the number of soakings in TEOS (samples A: 3 soakings; samples B: 5 soakings) and to the deposition of 15 nm nanoparticles followed by the deposition of TEOS (not carried out in Protocol 1, carried out in Protocol 2) carried out after deposition of the nanoparticles in solution in TEOS.

Briefly, the experimental conditions are summarized below:

Protocol 1

1) Pre-washing
2) Mixture of {NP100+NP15+TEOS solution (10 mM)}=Solution 1
3) Dip-coating in Solution 1: 3 DC (A) and 5 DC (B)
4) Silane Protocol 2:

1) Pre-washing
2) Mixture of {NP100+NP15+TEOS solution (10 mM)}=Solution 1
3) Dip-coating in Solution 1:3 DC (A) and 5 DC (B)
4) 1 DC of NP15
5) 1 DC of TEOS
6) Silane The pieces are dried at 80° C. for 1 hour after each dip-coating step and for 2 hours after deposition of the silane.

| Experimental conditions | CA (°) | Test 9-3 (loss in °) |
|---|---|---|
| A1 | 154 | 20 |
| A2 | 154 | 14 |
| B1 | 157 | 16 |
| B2 | 157 | 13 |

These results show a superhydrophobic effect and a good mechanical and chemical resistance of the surfaces obtained by this process.

17: Simultaneous Deposition of a Mixture of Different Particle Sizes and of TEOS by Spray The surface preparation conditions are similar to Example 16. The same solutions were prepared and used.

PMMA is first activated by UV-ozone and coated with a TEOS primer layer as defined in Example 20.

Briefly, the experimental conditions are summarized below:

Protocol

1) Pre-washing/activation and deposition of the TEOS primer layer
2) Mixture of {NP100+NP15+TEOS solution (10 mM)}=Solution 1
3) Spray-coating of Solution 1:3 sprays (A) and 5 sprays (B)
4) Silane Solution 1 was sprayed using a 50 mL atomizer placed 15 cm from the surface in a vertical position.

The pieces are dried at 80° C. for 1 hour after each spray step and for 2 hours after deposition of the silane.

| Material | Protocol | CA (°) | Test 9-3 (loss in °) |
|---|---|---|---|
| Glass | A | 139 | 7 |
| Glass | B | 146 | 13 |
| PMMA | A | 152 | 25 |
| PMMA | B | 148 | 20 |

These results show the feasibility of spray deposition of different nanoparticle populations on various supports. The coating obtained has the same resistance properties, irrespective of the number of sprays used.

18: Simultaneous Deposition of a Mixture of Raspberry Particles and TEOS by Dip-Coating For this example, the "isocyanate RNP" and the "amino RNP" prepared in Example 11 were used. They were mixed with a TEOS solution and then deposited on glass surfaces by the protocol described below.

Protocol 1:

1) Pre-washing
2) Mixture of {RNP (0.5% by weight) in TEOS solution (10 mM)}=Solution 1
3) 5 dip-coatings of Solution 1
4) Silanization Protocol 2:

1) Pre-washing
2) Mixture of {RNP (0.5% by weight) in TEOS solution (10 mM)}=Solution 1
3) 5 dip-coatings of Solution 1
4) 1 dip-coating of NP15
5) 1 dip-coating of TEOS
6) Silanization The pieces are dried at 80° C. for 1 hour after each dip-coating step and for 2 hours after deposition of the silane.

| RNP | Experimental conditions | CA (°) | Test 9-3 (loss in °) |
|---|---|---|---|
| Amino | 1 | 143 | 36 |
| | 2 | 143 | 18 |
| Isocyanate | 1 | 151 | 10 |
| | 2 | 153 | 12 |

These results show that the process using isocyanate RNP performs much better than that using amino RNP because the contact angles are greater by 8° to 10° and their resistance to rubbing is greater. In the case of isocyanate RNP, adding an additional population of NP15 does not significantly improve the stability of the coating whereas it is necessary for the amino RNP. In the latter case, the stability is due to the accumulation of particle layers and not to the stability of the amino RNP themselves.

19: Simultaneous Deposition of a Mixture of Raspberry Particles and of TEOS by Spray The surface preparation conditions are similar to those of Example 16. The same solutions were prepared and used. PMMA is first activated by UV-ozone and coated with a TEOS primer layer as defined in Example 20. The raspberry nanoparticles used are isocyanate nanoparticles as prepared in Example 11.

Briefly, the experimental conditions are summarized below:

Protocol:

1) Pre-washing/activation and deposition of the TEOS primer layer
2) Mixture of {RNP (0.5% by weight) in TEOS solution (10 mM)}=Solution 1
3) Spray-coating of Solution 1:3 sprays (A) and 5 sprays (B)
4) Silane Solution 1 was sprayed using a 50 mL atomizer placed 15 cm from the surface in a vertical position.

The pieces are dried at 80° C. for 1 hour after each spray step and for 2 hours after deposition of the silane.

| Material | Protocol | CA (°) | Test 9-3 (loss in °) |
|---|---|---|---|
| Glass | A | 154 | 24 |
| Glass | B | 153 | 25 |
| PMMA | A | 154 | 31 |
| PMMA | B | 153 | 24 |

These results show the feasibility of spray deposition of raspberry nanoparticles on various supports. The coating obtained has the same resistance properties, irrespective of the number of sprays used and irrespective of the material.

20: Deposition of a TEOS Adhesion Primer on Polymers

After UV-ozone activation as described in Example 13, PMMA plates (5×5 $cm^2$) are immersed in TEOS solutions at concentrations of (A) 10 mM, (B) 80 mM, (C) 250 mM in a water-alcohol mixture.

Next, the plates are used to deposit thereon a hydrophobic (protocol 1) or superhydrophobic (protocol 2) coating according to the following procedures:

Protocol 1:

1) Pre-washing and UV-ozone activation
2) Deposition of TEOS primer by dip-coating at concentrations of (A) 10 mM, (B) 80 mM, (C) 250 mM
3) Silane Protocol 2:

1) Pre-washing and UV-ozone activation
2) Deposition of TEOS primer by dip-coating at a concentration of (B) 80 mM
3) Deposition of particles by dip-coating according to the procedure of Example 10
4) Silane The pieces are dried at 80° C. for 1 hour after each dip-coating step and for 2 hours after deposition of the silane.

| Protocol | CA (°) | Test 9-3 (loss in °) |
|---|---|---|
| A1 | 117 | 31 |
| B1 | 116 | 5 |
| C1 | 117 | 5 |
| B2 | 144 | 13 |

These results show that, without particles on the surface (Protocol 1), it is possible to deposit a hydrophobic layer on PMMA first treated with a TEOS primer layer. This TEOS must have a sufficient concentration to allow the coating to behave satisfactorily on the surface. In this example, the behavior for a 10 mM concentration of TEOS is poorer than at higher concentrations. However, simply depositing an adhesion primer layer followed by functionalization by a hydrophobic layer is not sufficient to obtain the superhydrophobic property (contact angle less than 130°).

The results of Protocol 2, in turn, show that it is possible to obtain superhydrophobic surfaces on PMMA first treated with a TEOS primer layer. In this example, Protocol 2 gives results similar to those obtained for glass (see Example 10).

21: Deposition of a Superhydrophilic Coating on Glass

In this example, "isocyanate RNP" prepared in Example 11 were used according to a process similar to that of Example 18, with the exception that the deposition of the final hydrophobic layer was not carried out.

They were mixed with a TEOS solution and then deposited on glass surfaces by the protocol described below.

Protocol:

1) Pre-washing
2) Mixture of {RNP (0.5% by weight) in 10 mM TEOS solution}=Solution 1
3) 5 dip-coatings of Solution 1
4) Drying for 1 hour at room temperature (condition A) or at 80° C. (condition B)

| Material | Experimental conditions | CA (°) |
|---|---|---|
| Glass | A | <5° |
| | B | <5° |

The superhydrophilic and anti-fogging effect is illustrated in FIG. 16, where the image shows glass cooled to −20° C. which remains transparent on the treated portion whereas it is clouded by condensation on the untreated portion.

The superhydrophilic property is also clearly shown by contact angles close to 0°.

The invention claimed is:

1. A process for coating surfaces without the use of heat comprising:

a) depositing at least two nanoparticle populations, of different sizes, on a surface to be treated, and b) Cross-linking the nanoparticle-coated surface using an acidic hydroalcoholic solution containing TEOS as the only cross-linking agent on the surface to be treated to form a cross-linked surface, wherein heat is not applied to the surface to be treated.

2. The process according to claim 1, wherein said nanoparticle populations are mixed with said cross-linking agent before being deposited on said surface.

3. The process according to claim 1, wherein said nanoparticle populations are deposited successively on said surface.

4. The process according to claim 1, wherein said surface is treated with the cross-linking agent after each deposition of nanoparticles.

5. The process according to claim 1, wherein step a) contains the following sub-steps:

a1) Treating the first nanoparticle population with an adhesion agent, a2) Contacting said first nanoparticle population with one or more other nanoparticle populations, a3) Optionally, purifying the particles thus formed, a4) Depositing the particles formed in steps a2) or a3) on said surface.

6. The process according to claim 5, wherein said adhesion agent is an isocyanate or epoxide compound.

7. The process according to claim 1, wherein said surface is treated with the cross-linking agent after all of said nanoparticles have been deposited.

8. The process according to claim 5, wherein the nanoparticles formed in steps a2) or a3) are mixed with said cross-linking agent before step a4).

9. The process according to claim 1, wherein said surface consists of silicon, aluminum, germanium, oxides thereof or alloys thereof, or of polycarbonate, polymethyl methacrylate (PMMA), polypropylene, polyvinyl acetate (PVA), polyamides (PA), polyethylene terephthalate (PET), polyvinyl alcohols (PVA1), polystyrenes (PS), polyvinyl chlorides (PVC) or polyacrylonitriles (PAN).

10. The process according to claim 1, wherein one of the two nanoparticle populations has a diameter comprised between 50 and 200 nm, and the other a diameter comprised between 5 and 50 nm.

11. The process according to claim 1, wherein said nanoparticles consist of silicon, germanium, alumina, titanium, oxides thereof or alloys thereof, or polycarbonate.

12. The process according to claim 1 further comprising c) coating the cross-linked surface with a layer of hydrophobic organic molecules.

13. The process according to claim 12, wherein said organic molecules are perfluorinated.

14. The process according to claim 12, wherein said organic molecules are of formula:

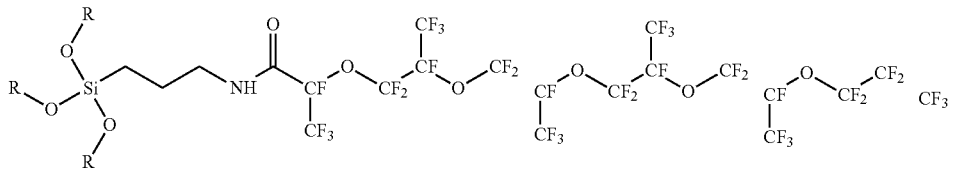

wherein R represents a linear or branched $C_1$-$C_4$ alkyl group.

15. The process of claim 1, wherein the deposition of the nanoparticles on the surface to be treated is carried out by a method selected from the group consisting of: dip-coating, spin-coating, spray, flow-coating, and wiping.

16. A process for coating surfaces comprising:

a) depositing at least two nanoparticle populations, of different sizes, on a surface to be treated, and b) cross-linking the nanoparticle-coated surface using an acidic hydroalcoholic solution containing TEOS as the only cross-linking agent, wherein the process does not involve heating the surface to be treated and the nanoparticles are not coated with a compound selected from the group consisting of: amine, cationic polymers, and combinations thereof.

17. The process of claim 16, wherein the deposition of the nanoparticles on the surface to be treated is carried out by a method selected from the group consisting of: dip-coating, spin-coating, spray, flow-coating, and wiping.

* * * * *